US008376606B2

(12) United States Patent
Yu

(10) Patent No.: US 8,376,606 B2
(45) Date of Patent: Feb. 19, 2013

(54) WATER RESISTANT AND REPLACEABLE LED LAMPS FOR LIGHT STRINGS

(75) Inventor: Jing Jing Yu, El Monte, CA (US)

(73) Assignee: 1 Energy Solutions, Inc., El Monte, CA (US)

( * ) Notice: Subject to any disclaimer, the term of this patent is extended or adjusted under 35 U.S.C. 154(b) by 326 days.

(21) Appl. No.: 12/610,117

(22) Filed: Oct. 30, 2009

(65) Prior Publication Data

US 2010/0073963 A1 Mar. 25, 2010

Related U.S. Application Data

(63) Continuation-in-part of application No. 12/254,787, filed on Oct. 20, 2008, now Pat. No. 7,883,261.

(60) Provisional application No. 61/043,262, filed on Apr. 8, 2008.

(51) Int. Cl.
*H01R 33/46* (2006.01)

(52) U.S. Cl. ..... 362/652; 362/653; 362/654; 362/655; 362/658; 439/680

(58) Field of Classification Search ..... 362/652–659, 362/249.02, 249.06, 249.14, 249.16, 651, 362/647; 439/619, 699.1, 699.2, 654–655, 439/660, 680
See application file for complete search history.

(56) References Cited

U.S. PATENT DOCUMENTS

| | | | |
|---|---|---|---|
| 1,694,997 | A | 12/1928 | VanHorn |
| 3,425,027 | A | 1/1969 | Uberbacher |
| 3,519,913 | A | 7/1970 | Janecek |
| 3,593,038 | A | 7/1971 | Hylten-Cavallius |
| 3,639,822 | A | 2/1972 | Brown |
| 3,758,771 | A | 9/1973 | Frohardt |
| 4,035,681 | A | 7/1977 | Savage |
| 4,074,165 | A | 2/1978 | Moriyama |
| 4,223,248 | A | 9/1980 | Tong |
| 4,298,869 | A | 11/1981 | Okuno |
| 4,316,125 | A | 2/1982 | Noguchi |
| 4,321,598 | A | 3/1982 | Warner |
| 4,329,625 | A | 5/1982 | Nishizawa |
| 4,348,663 | A | 9/1982 | Yanagishima |
| 4,365,244 | A | 12/1982 | Gillessen |
| 4,367,471 | A | 1/1983 | Gillessen |
| 4,396,823 | A | 8/1983 | Nihei |
| 4,492,952 | A | 1/1985 | Miller |
| 4,521,835 | A | 6/1985 | Meggs |
| 4,528,619 | A | 7/1985 | Dolan |
| 4,595,920 | A | 6/1986 | Runyan |
| 4,652,981 | A | 3/1987 | Glynn |
| 4,675,575 | A | 6/1987 | Smith |
| 4,727,603 | A | 3/1988 | Howard |
| 4,728,849 | A | 3/1988 | Morris et al. |
| 4,807,098 | A | 2/1989 | Ahroni |

(Continued)

FOREIGN PATENT DOCUMENTS

| | | |
|---|---|---|
| CA | 2342321 | 3/2000 |

OTHER PUBLICATIONS www.optics.org, The Online Photonics Resource.

(Continued)

*Primary Examiner* — Robert May
(74) *Attorney, Agent, or Firm* — William W. Cochran; Cochran Freund & Young LLC

(57) ABSTRACT

Disclosed is a waterproof lamp assembly that allows easy replacement of LED elements to be replaced. The electrical wires providing power to the light string are molded together with a lamp holder and covered with a lamp cover to create a watertight seal. The entire lamp assembly is waterproof and the LED elements are replaceable. No soldering is required in the assembly process.

4 Claims, 27 Drawing Sheets

U.S. PATENT DOCUMENTS 4,839,777 A 6/1989 Janko
4,843,280 A 6/1989 Lumbard
4,857,920 A 8/1989 Kataoka
4,954,822 A 9/1990 Borenstein
4,959,766 A 9/1990 Jain
4,967,330 A 10/1990 Bell et al.
5,087,212 A 2/1992 Hanami
5,130,897 A 7/1992 Kuzma
5,155,669 A 10/1992 Yamuro
5,187,377 A 2/1993 Katoh
5,193,895 A 3/1993 Naruke
5,239,872 A 8/1993 Meyer-Bisch
5,257,020 A 10/1993 Morse
5,313,187 A 5/1994 Choi
5,321,593 A 6/1994 Moates
5,323,305 A 6/1994 Ikeda
5,366,780 A 11/1994 Rapisarda
5,368,503 A 11/1994 Savage
5,404,282 A 4/1995 Klinke
5,410,458 A 4/1995 Bell
5,436,809 A 7/1995 Brassier
5,457,450 A 10/1995 Deese
5,463,280 A 10/1995 Johnson
5,481,444 A 1/1996 Schultz
5,499,174 A 3/1996 Lin
5,504,514 A 4/1996 Nelson
5,528,484 A 6/1996 Hayashi
5,567,037 A 10/1996 Ferber
5,580,156 A 12/1996 Suzuki et al.
5,580,159 A 12/1996 Liu
5,588,863 A 12/1996 Wu
5,634,711 A 6/1997 Kennedy et al.
5,647,759 A 7/1997 Lien
5,649,755 A 7/1997 Rapisarda
5,655,830 A 8/1997 Ruskouski
5,660,560 A 8/1997 Chong
5,663,719 A 9/1997 Deese
5,670,847 A 9/1997 Lin
5,672,000 A 9/1997 Lin
5,681,107 A 10/1997 Wang
5,688,042 A 11/1997 Madadi et al.
5,718,502 A 2/1998 Tseng
5,720,544 A 2/1998 Shu
5,722,860 A 3/1998 Pan
5,726,535 A 3/1998 Yan
5,762,419 A 6/1998 Yan
5,777,868 A 7/1998 Gibboney, Jr.
5,806,965 A 9/1998 Deese
5,808,592 A 9/1998 Mizutani
5,887,967 A 3/1999 Chang
5,890,794 A 4/1999 Abtahi
5,936,599 A 8/1999 Raymond
5,941,626 A 8/1999 Yamuro
5,962,971 A 10/1999 Chen
5,969,469 A 10/1999 Wang
5,988,831 A 11/1999 Pan
6,022,241 A 2/2000 Lin
6,048,074 A 4/2000 Wang
6,072,280 A 6/2000 Allen
6,079,848 A 6/2000 Ahroni
6,120,312 A 9/2000 Shu
6,183,104 B1 2/2001 Ferrara
6,183,310 B1 2/2001 Shu
6,190,021 B1 2/2001 Huang
6,194,839 B1 2/2001 Chang
6,200,003 B1 3/2001 Tseng
6,220,722 B1 4/2001 Begemann
6,227,679 B1 5/2001 Zhang
6,234,649 B1 5/2001 Katougi
6,283,797 B1 9/2001 Wu
6,361,192 B1 3/2002 Fussell et al.
6,361,198 B1 3/2002 Reed
6,367,952 B1 4/2002 Gibboney
6,382,812 B1 5/2002 Hsu
6,461,019 B1 10/2002 Allen
6,478,455 B2 11/2002 Ahroni
6,489,728 B2 12/2002 Guthrie et al.
6,505,954 B2 1/2003 Chen
6,550,953 B1 4/2003 Ishibashi
D474,848 S 5/2003 Lodhie
D474,849 S 5/2003 Lodhie
6,565,244 B1 5/2003 Murphy et al.
6,598,996 B1 7/2003 Lodhie
6,648,495 B1 11/2003 Hsu
6,659,632 B2 12/2003 Chen
D485,379 S 1/2004 Steklenbug
6,709,132 B2 3/2004 Ishibashi
6,717,526 B2 4/2004 Martineau
6,739,733 B1 5/2004 Lamke et al.
6,758,578 B1 7/2004 Chou
6,796,688 B2 * 9/2004 Huang ..... 362/362
6,830,358 B2 12/2004 Allen
6,869,313 B2 3/2005 Gibboney, Jr.
7,012,379 B1 3/2006 Chambers et al.
7,014,352 B2 3/2006 Wu
7,045,965 B2 5/2006 Yu
7,063,442 B2 6/2006 Sugar
7,066,628 B2 6/2006 Allen
7,066,636 B2 6/2006 Wu
7,086,756 B2 8/2006 Maxik
7,118,249 B2 10/2006 Hsu et al.
7,172,314 B2 2/2007 Currie et al.
7,217,005 B2 5/2007 Lin
7,220,022 B2 5/2007 Allen et al.
7,250,730 B1 7/2007 Allen
7,276,858 B2 10/2007 Allen
7,344,275 B2 3/2008 Allen et al.
7,350,936 B2 4/2008 Ducharme et al.
7,377,802 B2 5/2008 Allen
7,396,142 B2 7/2008 Laizure, Jr. et al.
7,488,094 B2 2/2009 Murayama et al.
7,501,772 B2 3/2009 Chung et al.
7,518,316 B2 4/2009 Yu
7,575,362 B1 * 8/2009 Hsu ..... 362/654
7,661,852 B2 2/2010 Yu
7,784,993 B2 8/2010 Yu
7,794,124 B2 9/2010 Hulsey et al.
7,850,361 B2 12/2010 Yu
7,850,362 B2 12/2010 Yu
7,852,011 B2 12/2010 Peng
7,883,261 B2 2/2011 Yu
7,963,670 B2 6/2011 Yu
8,016,440 B2 9/2011 Yu
8,083,393 B2 12/2011 Yu
2002/0043943 A1 4/2002 Menzer et al.
2002/0097586 A1 7/2002 Horowitz
2002/0105438 A1 8/2002 Forbes
2003/0025120 A1 2/2003 Chang
2003/0079387 A1 5/2003 Derose
2003/0147245 A1 8/2003 Chen
2003/0198048 A1 10/2003 Frederick
2004/0042205 A1 3/2004 Tanabe et al.
2004/0114367 A1 6/2004 Li
2004/0135522 A1 7/2004 Berman
2004/0140892 A1 7/2004 Hanood
2004/0184270 A1 9/2004 Halter
2004/0190289 A1 9/2004 Liu
2004/0190290 A1 9/2004 Zerphy et al.
2004/0233145 A1 11/2004 Chiang
2005/0047729 A1 3/2005 Vilgiate
2005/0057187 A1 3/2005 Catalano
2005/0162851 A1 7/2005 Kazar et al.
2005/0174769 A1 8/2005 Yong et al.
2005/0213324 A1 9/2005 Chen
2006/0007679 A1 1/2006 Allen
2006/0012349 A1 1/2006 Allen
2006/0012997 A1 1/2006 Catalano
2006/0028194 A1 2/2006 Bosch
2006/0044788 A1 3/2006 Damrau
2006/0098442 A1 5/2006 Yu
2006/0180822 A1 8/2006 Yu
2006/0181884 A1 8/2006 Li
2006/0203482 A1 9/2006 Allen
2006/0256585 A1 11/2006 Pan
2006/0270250 A1 11/2006 Allen
2006/0291256 A1 12/2006 Cobbler
2007/0025109 A1 2/2007 Yu

| | | | |
|---|---|---|---|
| 2007/0064450 | A1 | 3/2007 | Chiba et al. |
| 2007/0183153 | A1 | 8/2007 | Yu |
| 2007/0241357 | A1 | 10/2007 | Yan |
| 2008/0013324 | A1 | 1/2008 | Yu |
| 2008/0024071 | A1 | 1/2008 | Yu |
| 2008/0025024 | A1 | 1/2008 | Yu |
| 2008/0094857 | A1 | 4/2008 | Smith et al. |
| 2008/0143234 | A1 | 6/2008 | Yu |
| 2008/0157686 | A1 | 7/2008 | Chung et al. |
| 2008/0186704 | A1 | 8/2008 | Chou et al. |
| 2008/0258649 | A1 | 10/2008 | Yu |
| 2008/0285279 | A1 | 11/2008 | Ng et al. |
| 2009/0027903 | A1 | 1/2009 | Yu |
| 2009/0059565 | A1 | 3/2009 | Bertram |
| 2009/0116236 | A1 | 5/2009 | Chiang |
| 2009/0213602 | A1 | 8/2009 | Gallegos |
| 2010/0067222 | A1 | 3/2010 | Yu |
| 2010/0109560 | A1 | 5/2010 | Yu |
| 2010/0264806 | A1 | 10/2010 | Yu |

OTHER PUBLICATIONS http://ledmuseum.home.att.net/xmas1.htm;www.foreverbright.com.
U.S. Appl. No. 09/339,616; Inventor: Tuyet Thi Vo; abandoned.
U.S. Appl. No. 09/378,631, Inventor: Tuyet Thi Vo; abandoned.
U.S. Appl. No. 12/099,034, filed Apr. 7, 2008, by Jing Jing Yu.
U.S. Appl. No. 12/020,373, filed Jan. 25, 2008, by Jing Jing Yu.
U.S. Appl. No. 11/716,788, filed Mar. 12, 2007, by Jing Jing Yu.
U.S. Appl. No. 11/860,298, filed Sep. 24, 2007, by Jing Jing Yu.
U.S. Appl. No. 12/172,228, filed Jul. 12, 2008, by Jing Jing Yu.
U.S. Appl. No. 12/098,423, filed Apr. 5, 2008, by Jing Jing Yu.
U.S. Appl. No. 61/043,262, filed Apr. 8, 2008, by Jing Jing Yu.
U.S. Appl. No. 60/949,804, filed Jul. 13, 2007, by Jing Jing Yu.
U.S. Appl. No. 12/254,787, filed Oct. 20, 2008, by Jing Jing Yu.
Non-Final Office Action mailed May 23, 2005, in U.S. Appl. No. 10/767,820, filed Jan. 30, 2004 by Minzhu Li.
Non-Final Office Action mailed Aug. 18, 2008, in U.S. Appl. No. 11/461,293, filed Jul. 31, 2006, by Jing Jing Yu.
Non-Final Office Action mailed May 16, 2008, in U.S. Appl. No. 11/461,293, filed Jul. 31, 2006, by Jing Jing Yu.
Non-Final Office Action mailed Dec. 21, 2007, in U.S. Appl. No. 11/461,293, filed Jul. 31, 2006, by Jing Jing Yu.
Non-Final Office Action mailed Jun. 4, 2007, in U.S. Appl. No. 11/189,066, filed Jul. 26, 2005, by Jing Jing Yu.
Non-Final Office Action mailed Oct. 27, 2008, in U.S. Appl. No. 11/849,939, filed Sep. 4, 2007, by Jing Jing Yu.
Final Office Action mailed Sep. 25, 2008, in U.S. Appl. No. 11/849,939, filed Sep. 4, 2007, by Jing Jing Yu.
Non-Final Office Action mailed Mar. 20, 2008, in U.S. Appl. No. 11/849,939, filed Sep. 4, 2007, by Jing Jing Yu.
Non-Final Office Action mailed Feb. 7, 2006, in U.S. Appl. No. 10/984,651, filed Nov. 10, 2004, by Jing Jing Yu.
Non-Final Office Action mailed Feb. 15, 2007, in U.S. Appl. No. 11/056,148, filed Feb. 14, 2005, by Jing Jing Yu.
Non-Final Office Action mailed Jun. 14, 2007, in U.S. Appl. No. 11/350,343, filed Feb. 9, 20006, by Jing Jing Yu.
U.S. Appl. No. 12/431,098, filed Apr. 28, 2009, by Jing Jing Yu.
U.S. Appl. No. 11/831,929, filed Jul. 31, 2007, by Jing Jing Yu.
U.S. Appl. No. 12/542,903, filed Aug. 18, 2009 by Beijing Yu.
Chinese Patent Application No. 200920172743.1 filed Apr. 20, 2009 by Jing Jing Yu.
U.S. Appl. No. 12/542,903, filed Aug. 18, 2009 by Jing Jing Yu.

* cited by examiner

WATER RESISTANT AND REPLACEABLE LED LAMPS FOR LIGHT STRINGS

CROSS-REFERENCE TO RELATED APPLICATIONS

This application is a continuation-in-part application continuing from U.S. application Ser. No. 12/254,787, entitled "Water-Resistant and Replaceable LED Lamps," filed Oct. 20, 2008, which application is based upon and claims the benefit of U.S. Provisional Application No. 61/043,262 entitled "Water-Resistant and Replaceable LED Lamps," filed Apr. 8, 2008, the entire disclosures of which are herein specifically incorporated by reference for all that they disclose and teach.

BACKGROUND

Light-emitting diodes have been widely implemented as an alternative light source to the traditional incandescent and fluorescent lamps. One example of the use of LEDs is in decorative light strings. These are widely used because of the high power efficiency, long lifetime and low cost of LED elements. The use of decorative light strings is widely implemented for indoor and outdoor use. Lifetime of decorative light strings is greatly reduced when used outdoors due to the moisture exposure resulting from rain, snow and other airborne contaminants. Water-resistant lamp assemblies are essential to extending the lifetime of the LED bulbs, in addition to safety reasons.

SUMMARY

An embodiment of the present invention may therefore comprise a lamp assembly for a watertight LED light string that allows replacement of an LED element comprising: an LED bulb having two connector pins; a lamp holder having a central opening, two socket holes and a positioning hole formed in a lower portion of said lamp holder adjacent to said central opening; two electrical wires; two LED connectors that are connected to said two electrical wires and covered by plastic to form said two socket holes in said lamp holder; an LED adaptor having two holes that releasably accept said two connector pins so that said LED bulb can be replaced in said LED adaptor; two terminals disposed on a bottom portion of said LED adaptor that tightly engage said two LED connectors through said two socket holes; a positional pin disposed on said bottom portion of said LED adaptor that engages said positional hole so that said LED adaptor is disposed in said lamp holder in a predetermined direction; a lamp cover having a base that is secured to said lamp holder that forms a watertight seal between said base of said lamp cover and said lamp holder.

An embodiment of the present invention may further comprise a lamp assembly for a watertight LED string that allows replacement of an LED element comprising: an LED bulb having two connector pins; a lamp holder having a central opening and two socket holes formed in a lower portion of said lamp holder adjacent to said central opening; two electrical wires; two LED connectors that are connected to said two electrical wires and covered by plastic to form said two socket holes in said lamp holder; an LED adaptor having two holes that releasably accept said two connector pins so that said LED bulb can be replaced in said LED adaptor; two terminals disposed on a bottom portion of said LED adaptor that tightly engage said two LED connectors through said socket holes, said two terminals having different sizes so that said LED adaptor is disposed in said lamp holder in a predetermined direction; a lamp cover having a base that is secured to said lamp holder that forms a watertight seal between said base of said lamp cover and said lamp holder.

An embodiment of the present invention may further comprise a lamp assembly for a watertight LED string that allows replacement of an LED element comprising: an LED bulb having two connector pins; a lamp holder having a central opening and a directionally shaped socket hole formed in a lower portion of said lamp holder adjacent to said central opening; two electrical wires; two LED connectors that are connected to said two electrical wires and covered by plastic to form said directionally shaped socket hole in said lamp holder; an LED adaptor having two holes that releasably accept said two connector pins so that said LED bulb can be replaced in said LED adaptor; two terminals housed in a directionally shaped housing disposed on a bottom portion of said LED adaptor that tightly engage said two LED connectors through said socket hole so that said LED adaptor is disposed in said lamp holder in a predetermined direction; a lamp cover having a base that is secured to said lamp holder to form a watertight seal between said base of said lamp cover and said lamp holder.

An embodiment of the present invention may further comprise a method of providing a lamp assembly for a watertight LED light string that allows replacement of an LED element comprising: providing an LED bulb having two connector pins; providing two electrical wires; connecting two LED connectors to said two electrical wires; forming a lamp holder by covering said two electrical wires and said two LED connectors with plastic to form two socket holes in said lamp holder, said two socket holes disposed adjacent to a central opening formed in said lamp holder; forming a positioning hole in said lamp holder adjacent to said central opening during formation of said lamp holder; providing an LED adaptor having two holes that releasably accept said two connector pins so that said LED bulb can be replaced in said LED adaptor; forming two terminals in a bottom portion of said LED adaptor that tightly engage said two LED connectors through said two socket holes; forming a positional pin on said bottom portion of said LED adaptor that engages said positional hole so that said LED adaptor is disposed in said lamp holder in a predetermined direction; providing a lamp cover having a base that is secured to said lamp holder that forms a watertight seal between said base of said lamp cover and said lamp holder.

An embodiment of the present invention may further comprise a method of providing a lamp assembly for a watertight LED string that allows replacement of an LED element comprising: providing an LED bulb having two connector pins; providing two electrical wires; providing two LED connectors that have different sizes; connecting said two LED connectors to said two electrical wires; forming a lamp holder by covering said two electrical wires and said two LED connectors with plastic to form two socket holes in said lamp holder that have different sizes, said two socket holes disposed adjacent to a central opening formed in said lamp holder; providing an LED adaptor having two holes that releasably accept said two connector pins so that said LED bulb can be replaced in said LED adaptor; providing two terminals disposed on a bottom portion of said LED adaptor that tightly engage said two LED connectors through said socket holes, said two terminals having different sizes that match said different sizes of said socket holes such that said LED adaptor is disposed in said lamp holder in a predetermined direction; providing a lamp cover having a base that is secured to said lamp holder that forms a water tight seal between said base of said lamp cover and said lamp holder.

An embodiment of the present invention may further comprise a method of providing a lamp assembly for a watertight LED string that allows replacement of an LED element comprising: providing an LED bulb having two connector pins; providing two electrical wires; connecting two LED connectors to said two electrical wires; forming a lamp holder by covering said two electrical wires and said two LED connectors with plastic to form a directionally shaped socket hole in said lamp holder, said socket hole disposed adjacent to a central opening formed in said lamp holder; providing an LED adaptor having two holes that releasably accept said two connector pins so that said LED bulb can be replaced in said LED adaptor; forming two terminals housed in a directionally shaped housing disposed on a bottom portion of said LED adaptor that tightly engage said two LED connectors through said socket hole so that said LED adaptor is disposed in said lamp holder in a predetermined direction; providing a lamp cover having a base that is secured to said lamp holder that forms a watertight seal between said base of said lamp cover and said lamp holder.

DETAILED DESCRIPTION OF THE EMBODIMENTS

Figure 1:
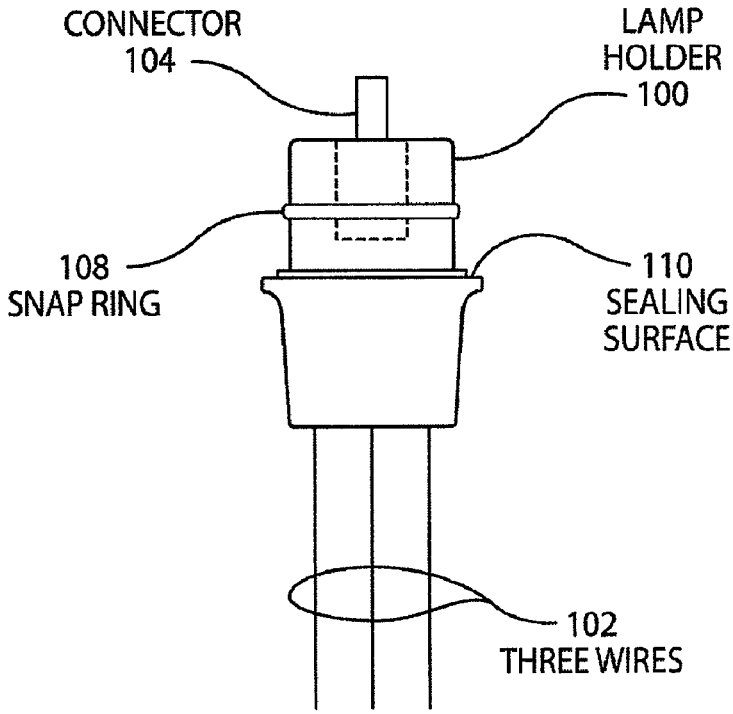
FIG. 1 is a side view of one embodiment of a lamp holder.

FIG. 1 is a side view of a lamp holder 100 that forms part of a lamp assembly for a waterproof lamp that uses replaceable LED elements. Many waterproof lamp assemblies are constructed as sealed units that use plastic injection molding to overmold the entire lamp assembly. This process provides water-resistance, but does not allow burned out LEDs to be replaced. In series wired LED strings, if one bulb is burned open, the remaining bulbs in the string will go dark. Parallel wiring techniques to overcome these problems are more complex and expensive to implement because of the additional wiring required. Further, light strings that use overmolding techniques often result in contact surfaces being coated with plastic material so that contact surfaces are not conductive and the light strings are faulty.

Figure 2:
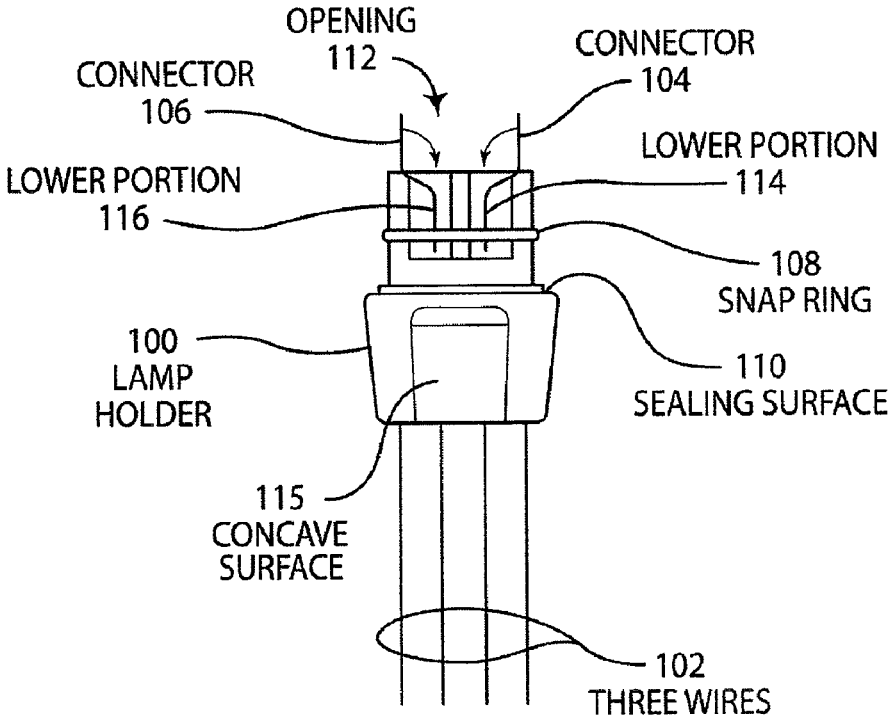
FIG. 2 is another side view of the lamp holder of FIG. 1.

Various approaches have been used to provide a replaceable bulb, especially in a waterproof package, such as disclosed in U.S. Patent Application Ser. No. 60/949,804, filed Jul. 13, 2007, by Jing Jing Yu, entitled "Watertight LED Lamp," and U.S. patent application Ser. No. 11/957,294, filed Dec. 14, 2007, by Jing Jing Yu, entitled "Substantially Inseparable LED Lamp Assembly," which are specifically incorporated herein by reference for all that they disclose and teach. The lamp holder 100, illustrated in FIG. 1, provides a different approach. As shown in FIGS. 1 and 2, lamp holder 100 includes connectors 104, 106 that are conductively connected to the three wires 102 at lower portions 114, 116, respectively. The connectors 104, 106 have an extended portion, that is illustrated in FIGS. 1 and 2, which are later bent into the opening 112 in the lamp holder 100. In this manner, the lamp holder 100 can be overmolded using plastic material with the extended portions of the connectors 104, 106 outside of the injection mold. Since the connectors 104, 106 extend upwardly away from the lamp holder 100, the injection molding process of overmolding the lamp holder 100 is simplified, and the connectors 104, 106 are outside of the injection mold.

In this manner, plastic material does not cover the connectors 104, 106. The connectors 104, 106 have sufficient malleability to allow the connectors 104, 106 to be bent into the opening 112 without breaking and provide an electrical connection with an LED element as disclosed below. The overmolding provides a watertight seal between the lamp holder 100 and three wires 102, as well as other portions of the lamp holder 100. The lamp holder 100 also includes a snap ring 108 that engages a lamp holder cover 600, illustrated in FIGS. 6-9, which also seals the lamp holder 100 to the lamp holder cover at sealing surface 110, as disclosed below. Snap ring 108 can be a separate piece that is attached to lamp holder 100 or can be molded into the lamp holder 100 during the injection molding process. Concave surface 115 provides an indication of the polarity in which the lamp holder 100 is connected to the three wires 102. The three wires 102 are typically used in parallel wired configurations for LED light strings.

Figure 3:
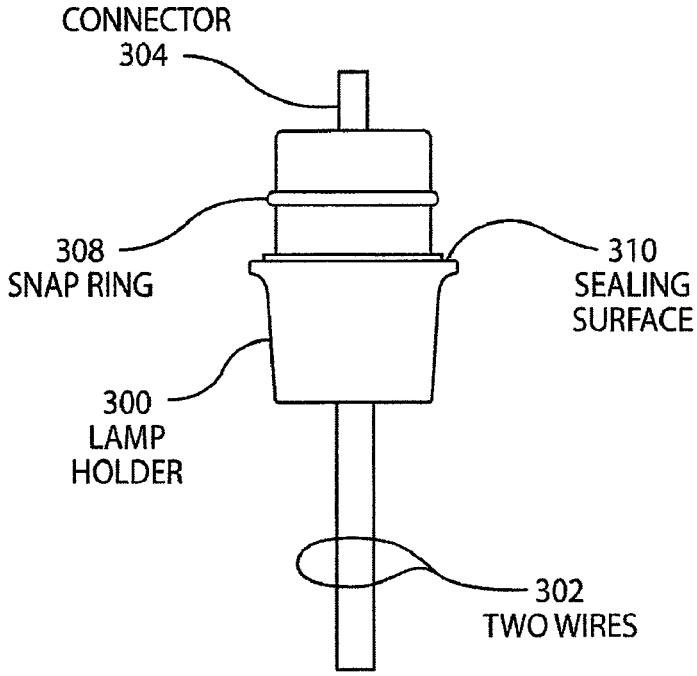
FIG. 3 is a side view of another embodiment of the lamp holder.
Figure 4:
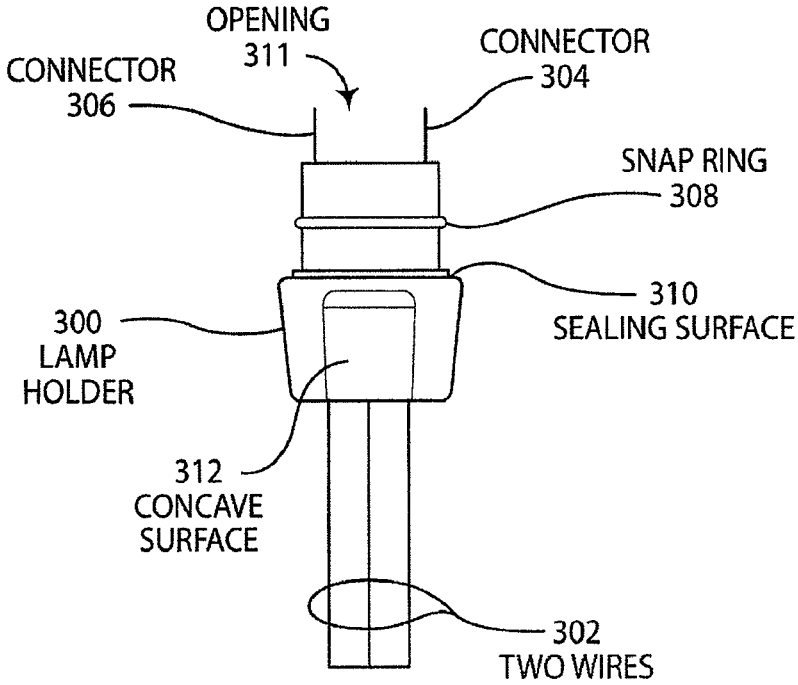
FIG. 4 is another side view of the embodiment of the lamp holder of FIG. 3.
Figure 5:
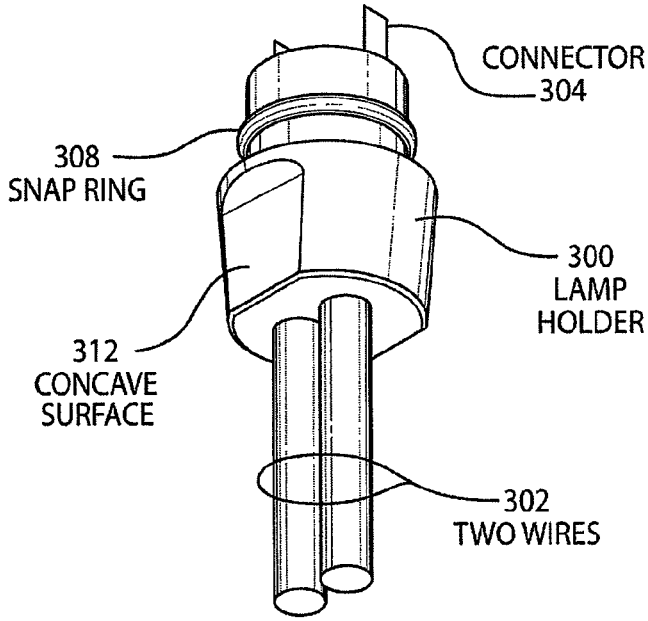
FIG. 5 is an isometric view of the lamp holder of FIG. 3.
Figure 6:
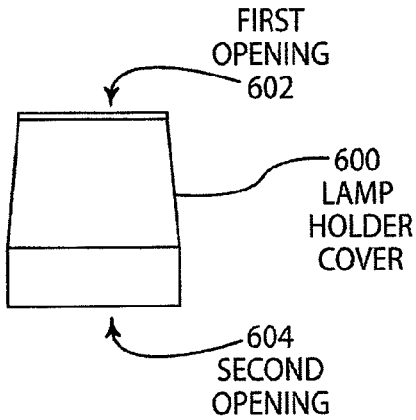
FIG. 6 is a side view of one embodiment of a lamp holder cover.
Figure 7:
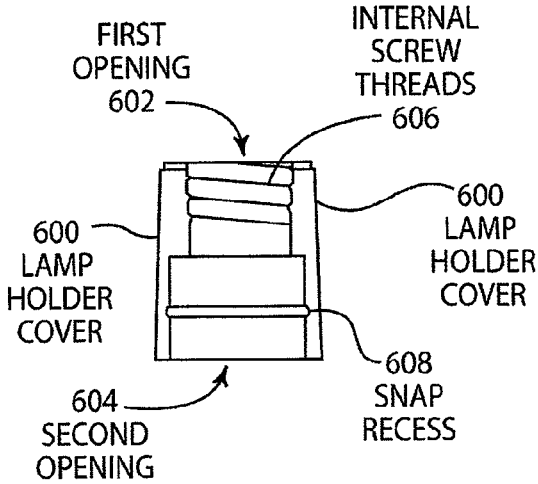
FIG. 7 is a cutaway view of the lamp holder cover of FIG. 6.
Figure 8:
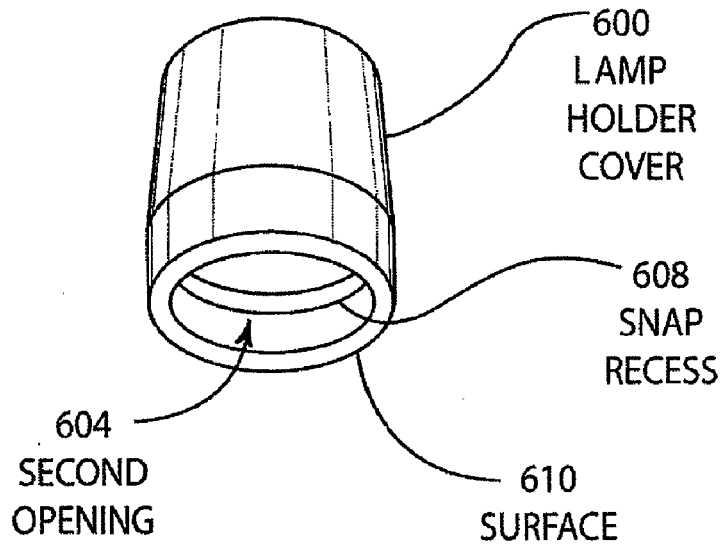
FIG. 8 is an isometric bottom view of the lamp holder cover of FIG. 6.
Figure 9:
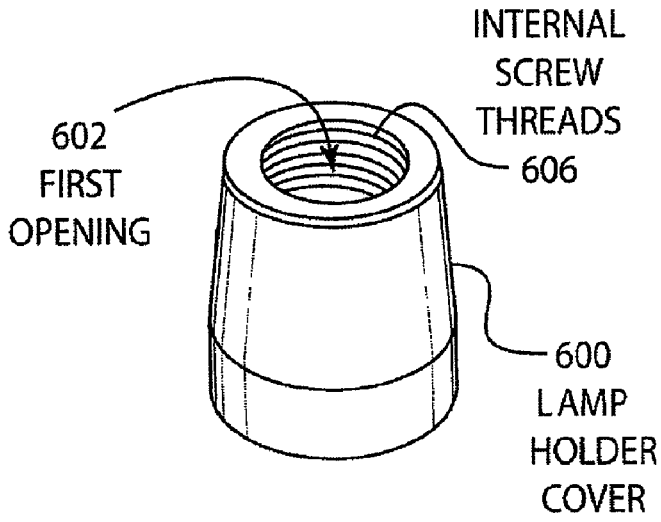
FIG. 9 is a top isometric view of the lamp holder cover of FIG. 6.

FIGS. 3-5 illustrate another embodiment of a lamp holder 300. As shown in FIGS. 3, 4 and 5, two wires 302 are connected to connectors 304, 306. Two wire connections are typically used in series wired configurations in LED light strings. Lamp holder 300 includes a snap ring 308 that connects to the lamp holder cover 600, illustrated in FIGS. 6-9. Again, snap ring 308 may be a separate piece or molded into lamp holder 300. The lamp holder cover 600 snaps onto the snap ring 308 and seals to the lamp holder 300 at sealing surface 310 and also around the snap ring 308. Connectors 304, 306 extend from the lamp holder 300 and allow the lamp holder to be easily overmolded without any plastic coating the connectors 304, 306. Connectors 304, 306 have sufficient malleability so that they can be bent into the opening 311 and provide an electrical connection with an LED element, such as LED element 1006 illustrated in FIG. 10. The concave surface 312 provides an indication of the polarity in which the lamp holder 300 is connected to the two wires 302.

FIGS. 6-9 illustrate an embodiment of a lamp holder cover 600 that can be connected to lamp holder 100 or lamp holder 300. As shown in FIGS. 6-9, lamp holder cover 600 includes a first opening 602 in a first end of the lamp holder cover 600, and a second opening 604 in a second end of the lamp holder cover 600. Lamp holder cover 600 includes internal screw threads 606 in the first opening 602 and a snap recess 608 in the second opening 604. The snap recess 608 is adapted to mate with snap ring 108 and snap ring 308 to attach and seal the lamp holder cover 600 to lamp holder 100 and lamp holder 300, respectfully. Snap recess can be machined into lamp holder cover 600, or can be molded into the lamp holder cover 600 as part of the injection molding process. Surface 610, adjacent second opening 604, abuts against sealing surfaces 110, 310 of lamp holders 100, 300, respectfully, to provide additional sealing. Both the snap recess 608 and the snap rings 108, 308 provide a watertight seal between the lamp holders 100, 300 and the lamp holder cover 600, as well as the abutment of surface 610 with sealing surfaces 110, 310 of lamp holders 100, 300, respectfully.

Figure 10:
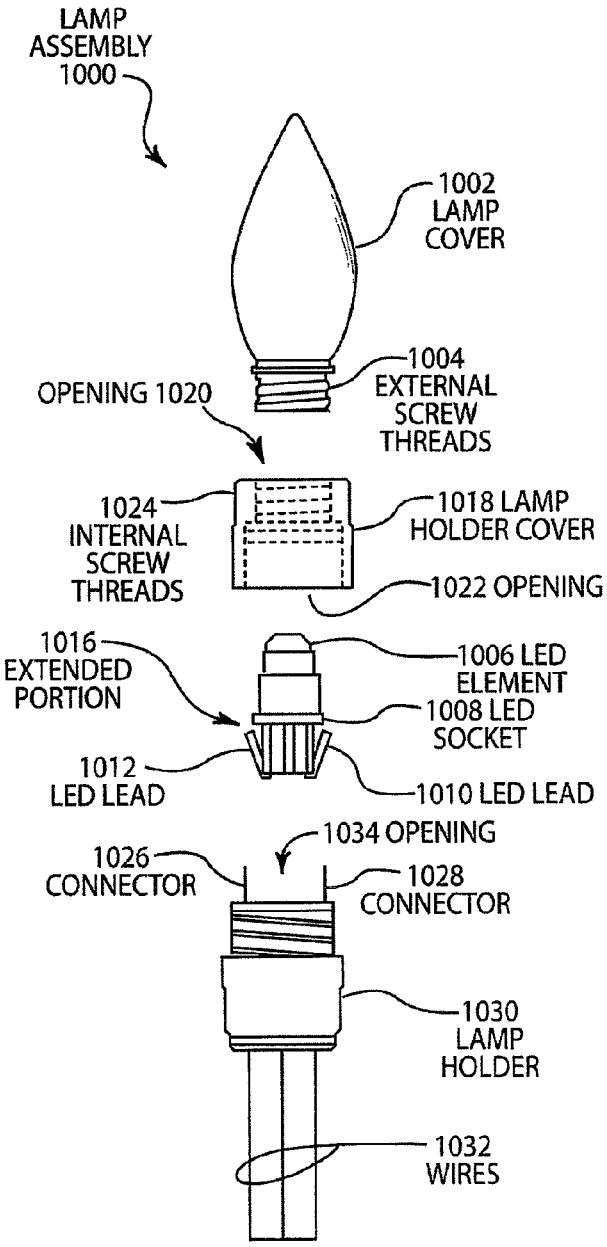
FIG. 10 is an assembly view of a lamp assembly.
Figure 11:
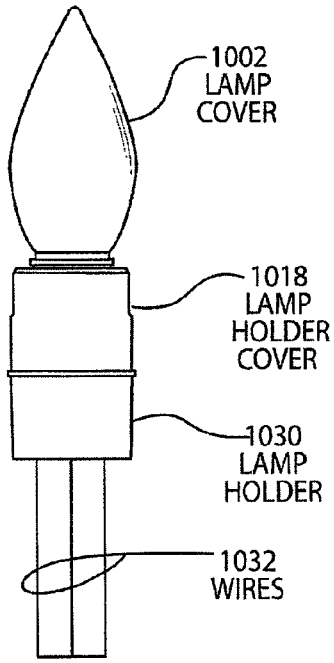
FIG. 11 is an assembled view of the lamp assembly of the lamp assembly of FIG. 10.

FIG. 10 is an assembly drawing of another embodiment of a lamp assembly 1000. As shown in FIG. 10, lamp cover 1002 has external screw threads 1004. External screw threads 1004 mate with internal screw threads 1024 of lamp holder cover 1018. As further shown in FIG. 10, LED element 1006 is connected to an LED socket 1008, such as disclosed in U.S. patent application Ser. No. 12/020,373, filed Jan. 25, 2008 by Jing Jing Yu, entitled "Removable LED Lamp Holder," and U.S. patent application Ser. No. 12/099,034, filed Apr. 7, 2008, by Jing Jing Yu and Sheng Wang Du entitled "Removable LED Lamp Holder With Socket" which are both specifically incorporated herein by reference for all that they disclose and teach. The combined LED element 1006 and LED socket 1008 are adapted to extend through first opening 1020 in the lamp holder cover 1018 so that the LED element 1006 projects light through the lamp cover 1002. In addition, the bottom portion of the LED socket 1008 extends through second opening 1022 of lamp holder cover 1018 into the opening 1034 of lamp holder 1030 after the connectors 1026, 1028 are bent into the opening 1034. LED leads 1010, 1012 abut against the connectors 1026, 1028, respectfully, to form an electrical contact. The extended portion 1016 of the socket 1008 has a size that forces the LED leads outwardly against connectors 1026, 1028 that are folded into the central opening of the lamp holder. In addition, the metal of connectors 1026, 1028, as well as the metal of LED leads 1010, 1012, although they are sufficiently malleable, have a modulus of elasticity that is sufficient to ensure that abutment occurs and a sufficient electrical contact is formed between the leads and the connectors. The same is true for the other connectors disclosed in the other embodiments set forth herein. Also, the interior walls of the lamp holder force the connectors against the LED leads, while the extended portion 1016 forces the LED leads against the connectors. In this fashion, a strong electrical connection is established. Connectors 1026, 1028 are connected to a power source by the wires 1032. Lamp holder cover 1018 is then screwed fit onto the lamp holder 1030 to provide a watertight sealed unit. The watertight sealed unit is illustrated in FIG. 11. Alternatively, a water tight snap fit can be used between lamp holder cover 1018 and lamp holder 1030.

As illustrated in FIGS. 10 and 11, the lamp assembly 1000 can be easily disassembled to replace the LED element 1006. The LED element 1006 can be disconnected from the LED socket 1008 and replaced, as described in the above referenced patent application entitled "Removable LED Lamp Holder," and the above referenced U.S. patent application entitled "Removable LED Lamp Holder With Socket," as well as U.S. Patent Application Ser. No. 60/949,804, filed Jul. 31, 2007, by Jing Jing Yu, entitled "Watertight LED Lamp," which is specifically incorporated herein by reference for all that it discloses and teaches. Alternatively, LED elements can be integrally mounted the socket for replacement as a single unit. Of course, the LED socket 1008 has a specific shape that mates with the opening 1034 in lamp holder 1030 so that the correct polarity of the LED element is maintained during assembly. In addition, whereas FIGS. 10 and 11 are illustrated with respect to the embodiments illustrated in FIGS. 1 and 2, the embodiments of FIGS. 3 and 4 can be similarly employed in the manner illustrated in FIGS. 10 and 11.

Figure 12:
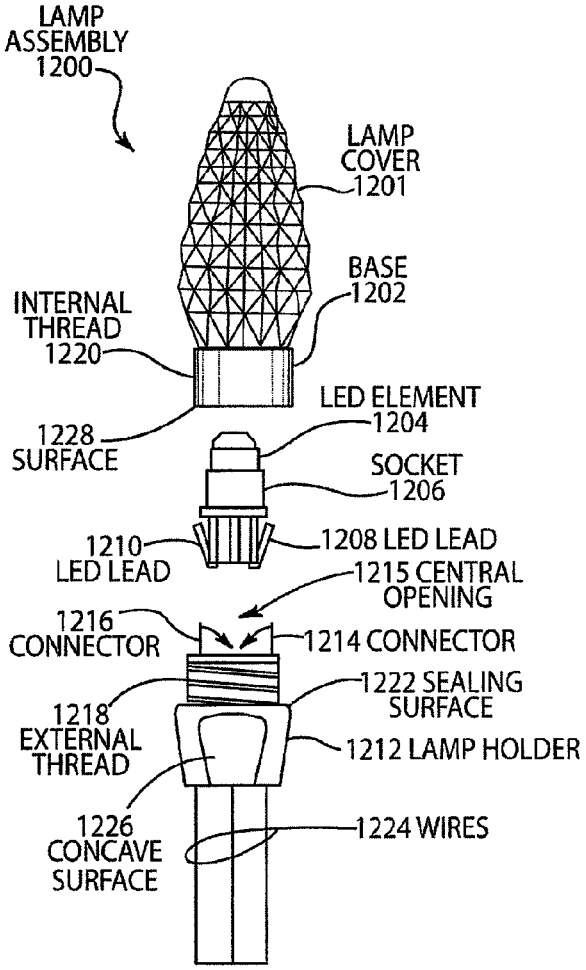
FIG. 12 is an assembly view of another embodiment of a lamp assembly.
Figure 13:
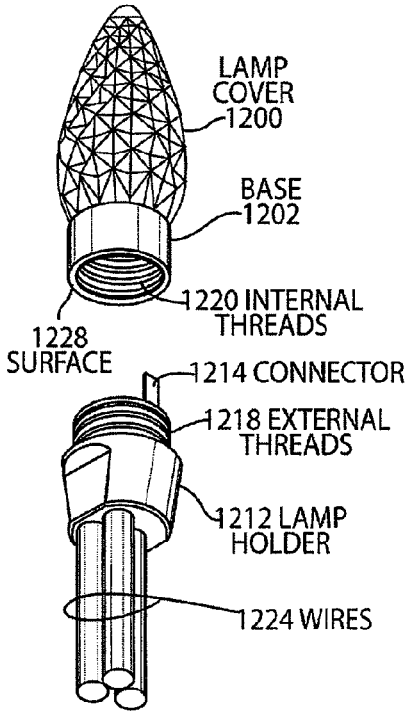
FIG. 13 is an isometric view of the embodiment of FIG. 12.

FIGS. 12 and 13 illustrate another embodiment of the lamp assembly 1200. As shown in FIGS. 12 and 13, lamp assembly 1200 includes a lamp cover 1201 having a base 1202 that has internal threads 1220. Surface 1228 is disposed along the bottom portion of the base 1202. LED element 1204 is coupled to socket 1206. Socket 1206 may have openings that allow LED leads 1208, 1210 to extend through the socket and wrap around an external extended portion of the socket 1206, as illustrated in FIG. 12. Lamp holder 1212 is overmolded around wires 1224 and around lower portion of connectors 1214, 1216. Connectors 1214, 1216 extend outwardly from the lamp holder 1212 and are not overmolded on the extended portions that are illustrated in FIG. 12. Connectors 1214, 1216 are made from a malleable material so that connectors 1214, 1216 can be folded into a central opening 1215 in lamp holder 1212. The metal of connectors 1214, 1216, also has a modulus of elasticity that is sufficient to ensure that the connectors 1214, 1216 abut against LED leads 1208, 1210. LED leads 1208, 1210 are also sufficiently malleable to wrap around the outside of socket 1206 while having sufficient elasticity to ensure that the LEDs abut against the connectors to form a strong electrical connection. For example, both the connectors and the LED leads can be mixed with a ferrous material to form an alloy to increase the elasticity of the metal used in the connectors and the LED leads. The amount of carbon included in the ferrous metal determines the elasticity and resistance to bending. However, an increase in elasticity also increases the resistance of these materials. In that regard, both the connectors and the LED leads can be coated with a substantially pure copper layer to increase the electrical conductivity between the connectors and the LED leads. Lamp holder 1212 also includes external threads 1218 and a sealing surface 1222. Surface 1228 abuts against surface 1222 to form a watertight seal when the internal threads 1220 of the base 1202 are threaded with the external threats 1218 of the lamp holder 1212. The abutment of surface 1228 with sealing surface 1222 provides a watertight seal, together with the interlocking thread of the internal thread 1220 and the external thread 1218. Concave surface 1226 provides a visual indication of the polarity in which the lamp holder 1212 is connected to wires 1224.

Hence, the embodiments disclose a waterproof lamp assembly that allows quick and easy replacement of LED elements. The waterproof lamp assembly allows the assembly to be used on light strings for both interior and exterior use on a prolonged basis. The lamp assembly can be easily assembled and disassembled for easy replacement of burned out LED elements. In addition, contacts that extend beyond the lamp holder are not subject to being coated by plastic during a plastic injection overmolding process of forming the lamp holder. Reliability and ease of manufacturing reduces costs and allows greater reliability in the operation of the lamp holder.

Variations of the methods of attachment of the lamp holder cover and lamp cover of the embodiments are disclosed above, can be used. For example, either an internal or external screw thread on the lamp holders 100, 300 can be used to attach the lamp holder cover. Similarly, friction-fit techniques and other techniques, including the snap ring and snap recess releasable attachment techniques, can also be used for attaching the lamp holders and lamp holder covers. Further, any of these techniques can be used to connect the lamp cover with the lamp holder of the embodiments of FIGS. 1-11. Similarly, any of these techniques can be used to attach the lamp cover 1201 to the lamp holder 1212.

Figure 14:
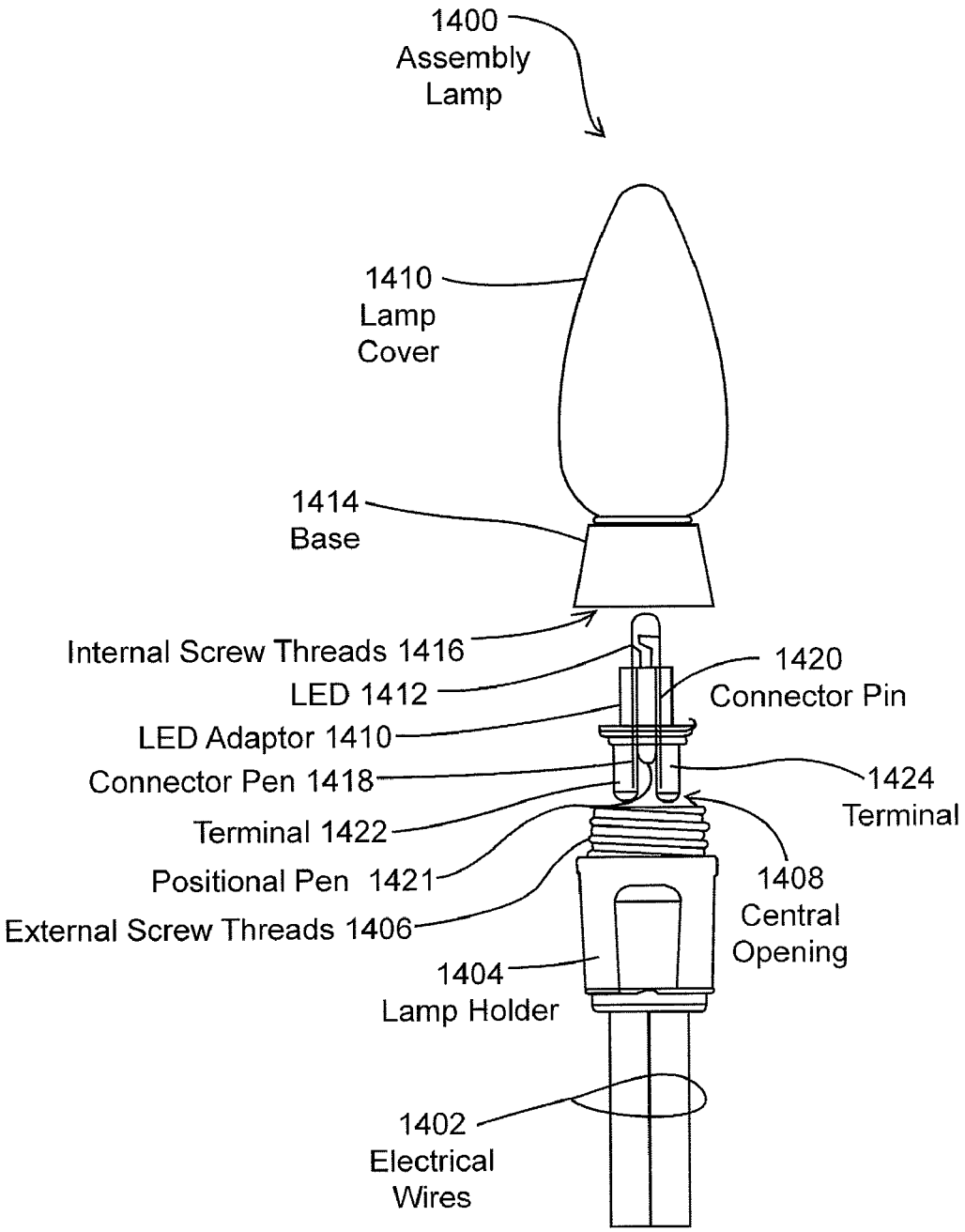
FIG. 14 is a side view of one embodiment of an assembly lamp.

FIG. 14 is an assembly view of an assembly lamp 1400 for a waterproof lamp that uses replaceable LED elements. Various approaches have been used to provide a replaceable bulb, especially in a waterproof package, such as disclosed in U.S. Patent Application Ser. No. 60/949,804, filed Jul. 13, 2007, by Jing-Jing Yu, entitled "Watertight LED Lamp," U.S. patent application Ser. No. 11/957,294, filed Dec. 14, 2007, by Jing-Jing Yu, entitled "Substantially Inseparable LED Lamp Assembly," which are specifically incorporated herein by reference for all that they disclose and teach.

Assembly lamp 1400, as shown in FIG. 14, provides a different approach. As shown in FIG. 14, assembly lamp 1400 comprises two electrical wires 1402 molded together with lamp holder 1404 that provides a water tight seal and therefore a longer life for the decorative LED light string. Lamp holder 1404 has a central opening 1408 so that LED adapter 1410 can tightly plug into lamp holder 1404 to help facilitate a watertight seal for assembly lamp 1400 and easily replace LED bulb 1412. Positioning pin 1421 and terminals 1422, 1424 are inserted in lamp holder 1404 and are tightly engaged with socket holes 1802, 1804 and positioning hole 1806 shown in FIG. 18. Positioning pin 1421 is used to ensure proper directional positioning of LED adaptor 1410 into lamp holder 1404. The LED bulb 1412 is connected to the LED adapter 1410 by inserting connector pins 1418, 1420 into the LED adaptor. The LED bulb 1412 is easily replaceable by disconnecting the connector pins 1418, 1420 on the LED bulb 1412 from the LED adaptor 1410. Lamp cover 1410 has a base 1414 that has internal screw threads 1416 that are tightly coupled with external screw threads 1406 on the lamp holder 1404 to form a watertight seal for lamp assembly 1400. The electrical wires 1402 provide electrical power to the LED 1412 and a connection to other LED lamps in an LED light string. Lamp holder 1404 provides watertight seal for the connection between the wires 1402 and the LED 1412 since the wires 1402 are covered with the plastic of the lamp holder 1404, such as by overmolding. Lamp holder 1404 also provides watertight housing for the LED components through the central opening 1408 on the lamp holder 1404. The entire structure assembly lamp 1400 is waterproof and the LED 1412 is easily replaceable.

Figure 15:
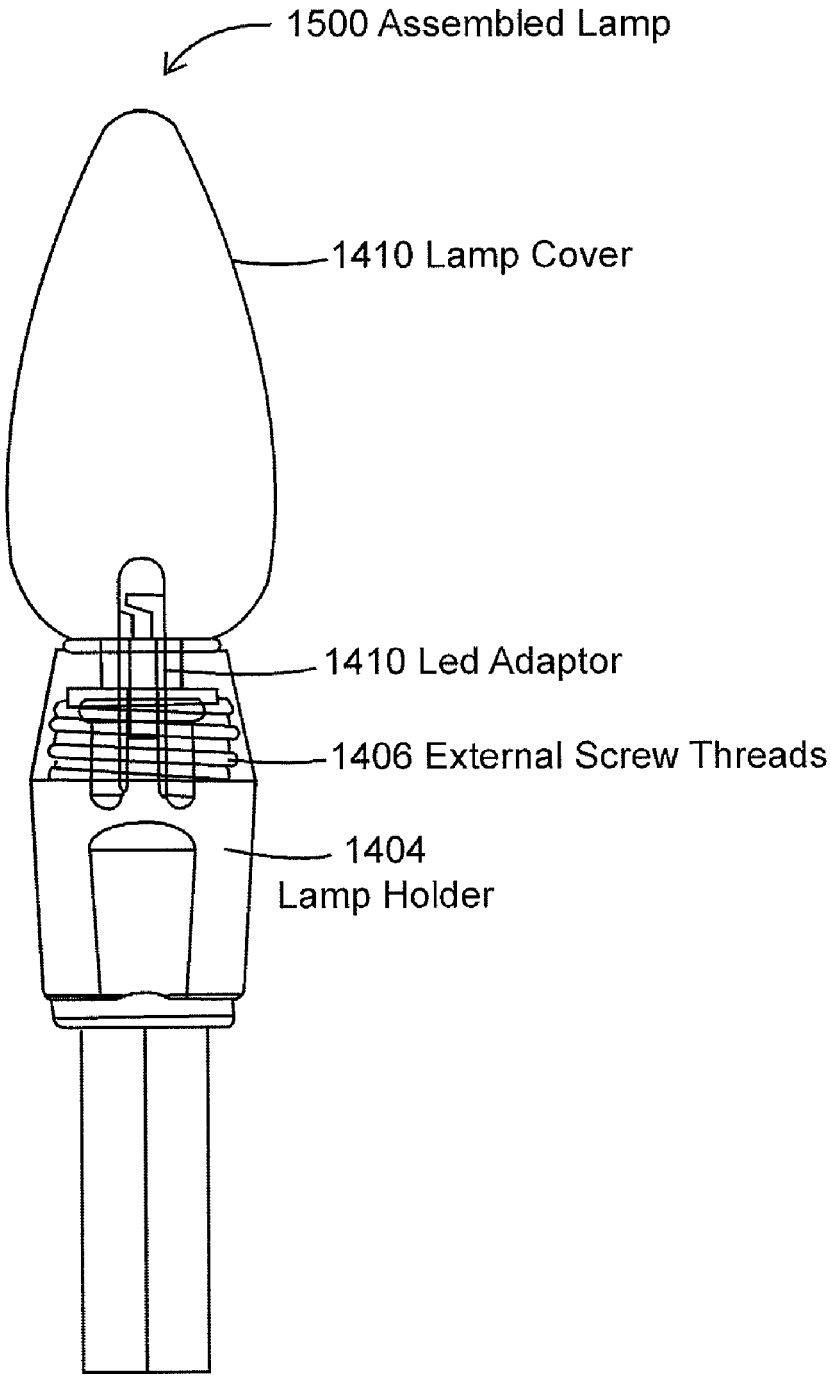
FIG. 15 is another side view of the assembled lamp of FIG. 14.

FIG. 15 shows an assembled view of the assembled lamp 1500 of FIG. 14. Lamp cover 1410 is shown coupled with external screw threads 1406, and the LED adapter 1410 is shown disposed within lamp holder 1404. The entire structure of assembled lamp 1500 is watertight and the LED is replaceable. There is no soldering required in the assembly process.

Figure 16:
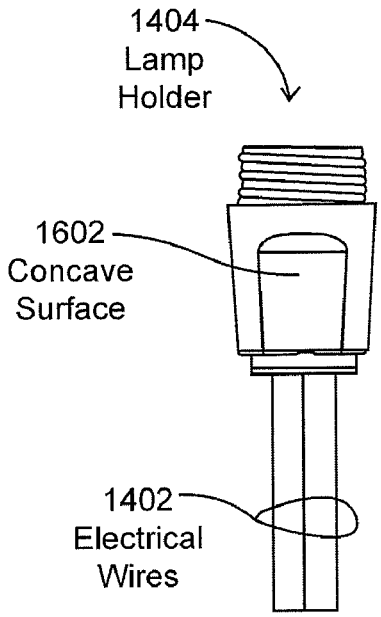
FIG. 16 is a side view of the lamp holder of FIG. 14.

FIG. 16 shows a side view of lamp holder 1404 as was shown in FIG. 14. Concave surface 1602 provides an indication of the polarity in which the lamp holder 1404 is connected to the two electrical wires 1402.

Figure 17:
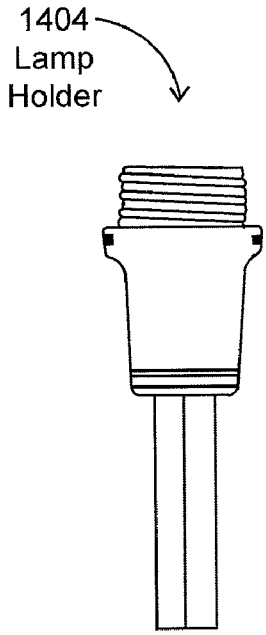
FIG. 17 is another side view of the embodiment of the lamp holder of FIG. 14.

FIG. 17 shows another side view of the embodiment of the lamp holder 1404 with the lamp holder 1404 rotated 90° from the depiction in FIG. 16. The concave surface 1602 is disposed on only one side of the lamp holder 1404 and, as such, provides polarity information.

Figure 18:
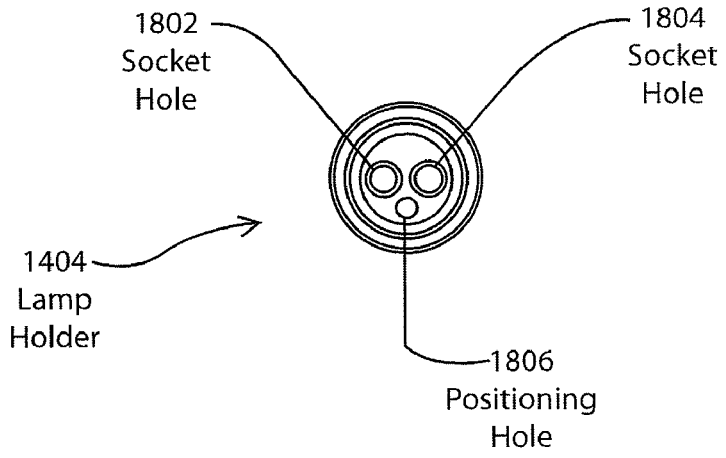
FIG. 18 is a top view of the embodiment of the lamp holder in FIG. 14.

FIG. 18 is a top view of lamp holder 1404 showing socket holes 1802, 1804, and a positioning hole 1806 that are formed in a lower portion of lamp holder 1404. The terminals 1422, 1424 and positioning pin 1421 of LED adapter 1410 (FIG. 14) correspond to and are insertable in socket holes 1802, 1804, and positioning hole 1806 so that the LED adaptor 1410 can be tightly engaged in socket holes 1801, 1804, and positioning hole 1806 as shown in FIG. 14 in the proper polarity direction. In that regard, positioning hole 1806 ensures proper directional positioning of LED adaptor 1410.

Figure 19:
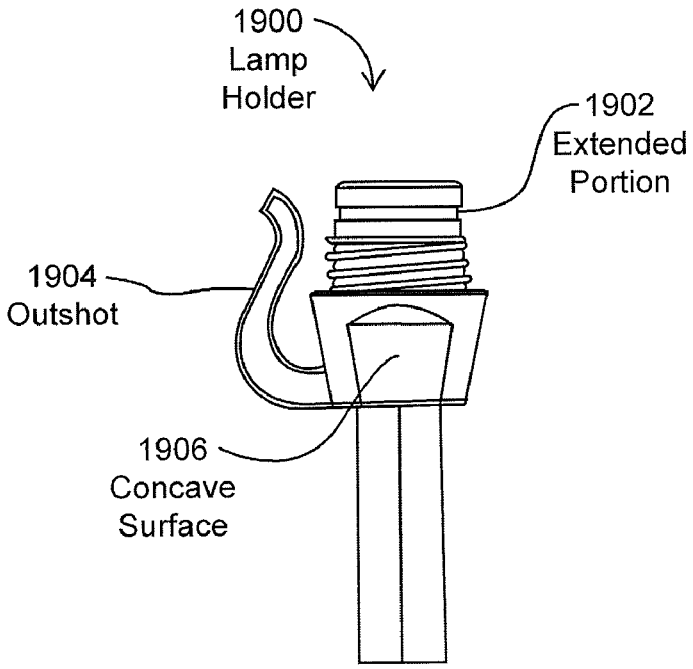
FIG. 19 is a side view of another embodiment a lamp holder.

FIG. 19 shows a side view of another embodiment of a lamp holder that forms a lamp assembly for a waterproof and replaceable lamp. Lamp holder 1900 shown in FIG. 19 has an extended portion 1902 to further ensure a tight seal between lamp holder 1900 and the LED adapter 1410 housed within lamp holder 1900. Out shot 1904 and concave surface 1906 indicate the polarity of the lamp.

Figure 20:
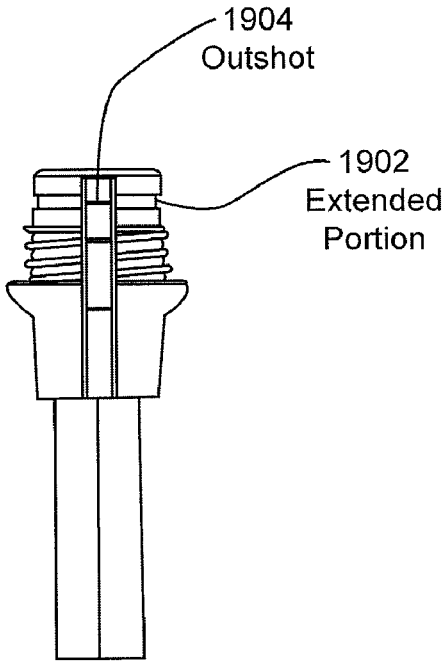
FIG. 20 is another side view of the embodiment of the lamp holder of FIG. 19.

FIG. 20 is an additional side view of the embodiment of lamp holder 1900, as shown in FIG. 19. FIG. 20 shows extended portion 1902 and out shot 1904 that was shown in FIG. 19.

Figure 21:
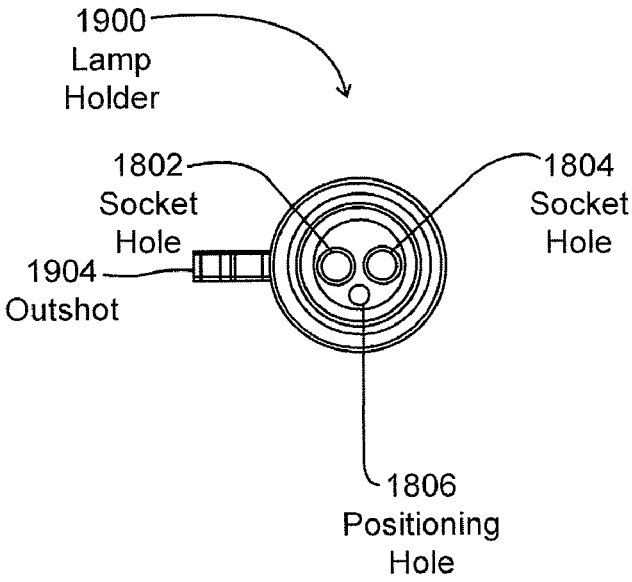
FIG. 21 is a top view of the embodiment of the lamp holder of FIG. 19.

FIG. 21 shows a top view of lamp holder 1900 of the embodiment of FIGS. 19 and 20. Out shot 1904 indicates the polarity of the lamp. Socket holes 1802, 1804, and positioning hole 1806 are used to match the LED adapter 1410 with lamp holder 1900, to ensure proper positioning of LED adaptor 1410 and that LED adaptor 1410 is properly housed within lamp holder 1900.

Figure 22:
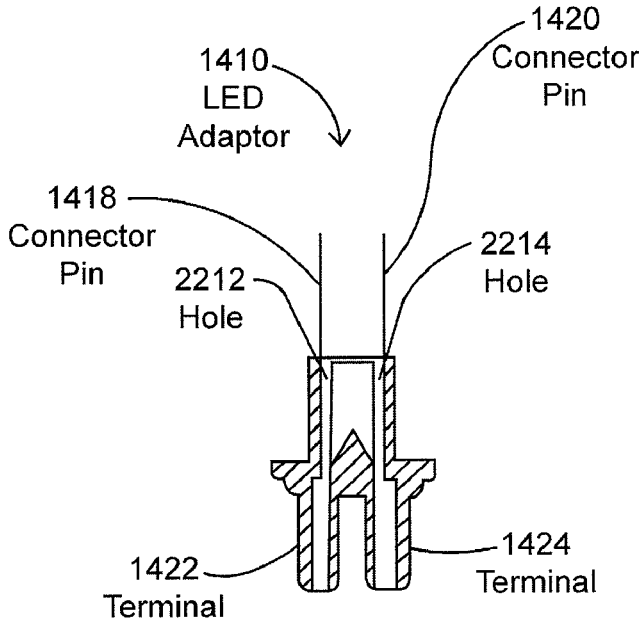
FIG. 22 is a side view of the LED adapter shown in FIG. 14.

FIG. 22 shows a cross sectional view of LED adaptor 1410 having terminals 1422, 1424 that tightly engage with socket holes 1802, 1804 (FIG. 21). LED adaptor 1410 can be inserted in and removed from socket holes 1802, 1804 to replace the LED. Holes 2212, 2214 releasibly accept connector pins 1418, 1420 of LED bulb 1412, as shown in FIG. 14. In other words, the connector pins 1418, 1420 can be inserted in holes 2212, 2214, and can also be withdrawn from holes 2212, 2214 to replace LED bulb 1412 shown in FIG. 14.

Figure 23:
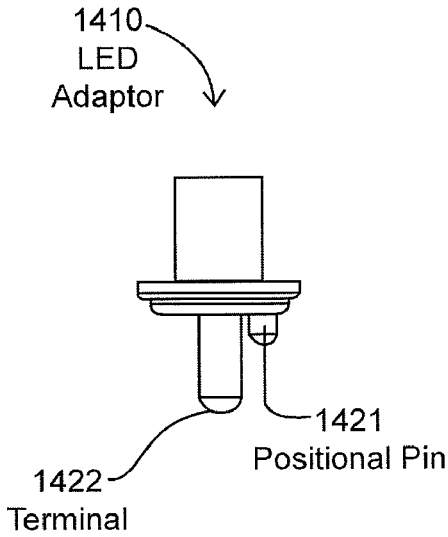
FIG. 23 is another side view of the LED adapter of FIG. 22.

FIG. 23 is a side view of LED adapter 1410 showing terminal 1422 that tightly engages with socket hole 1802, and positional pin 1421 that tightly engages with positioning hole 1806. Terminal 1422 and positional pin 1421 can be disengaged with socket hole 1802 (FIG. 21) and positioning hole 1806 (FIG. 21) to remove LED adaptor from lamp holder 1404.

Figure 24:
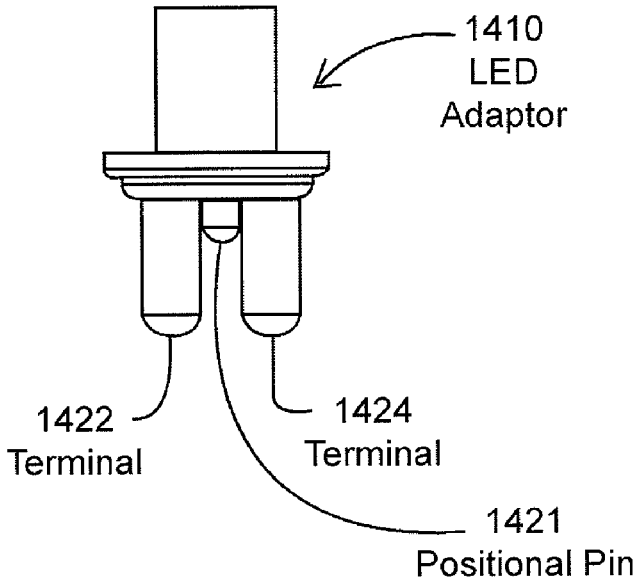
FIG. 24 is another side view of the LED adapter of FIG. 22.

FIG. 24 shows an additional side view of LED adapter 1410 showing terminals 1422, 1424, and positional pin 1421 that can tightly engage with, or be easily removed from, socket holes 1802, 1804, and positioning hole 1806.

Figure 25:
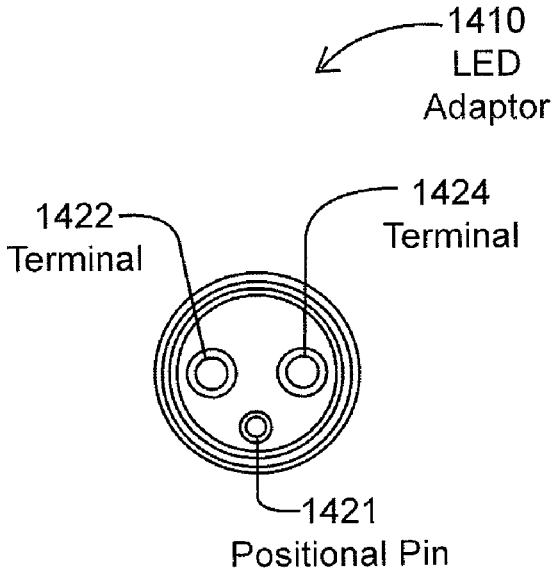
FIG. 25 is a top view of the LED adapter of FIG. 22.

FIG. 25 is a bottom view of LED adapter 1410. Terminals 1422, 1424, and positional pin 1421 are plugged into the two socket holes 1802, 1804 and the positioning hole 1806. The structure of the LED adapter 1410 makes it easy to replace an LED bulb 1412 while also providing a tight and safe matching between the lamp holder 1404 and the LED bulb 1412. LED adaptor 1410 is also compatible with the lamp holder of FIGS. 19-21 and is not restricted to lamp holder 1404.

Figure 26:
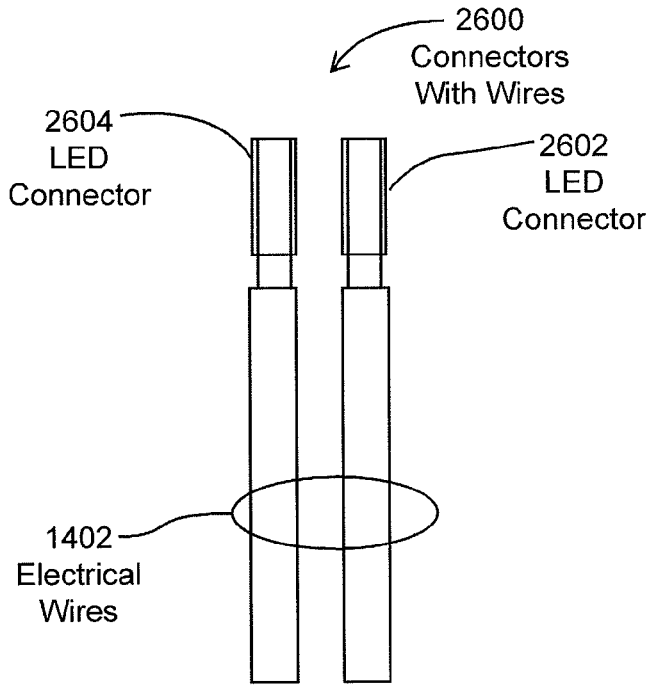
FIG. 26 is a side view an LED connector with wires.

FIG. 26 shows LED connectors 2602, 2604 that are connected to electrical wires 1402 that are deposited in lamp holder 1404, and are covered by a plastic coating to form a waterproof lamp holder 1404. This process can be accomplished by using standard overmolding techniques.

Figure 27:
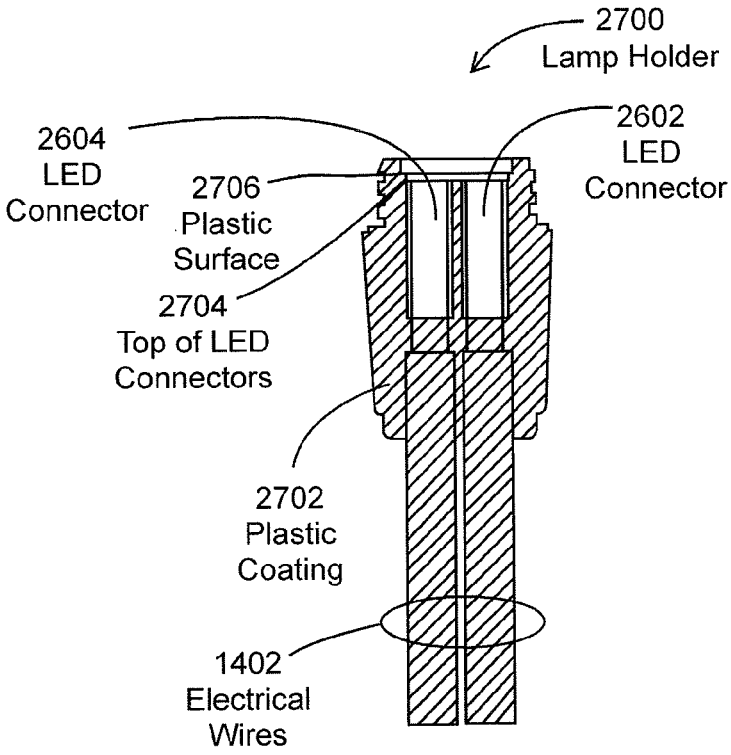
FIG. 27 is a cross sectional view of another embodiment of a lamp holder.
Figure 28:
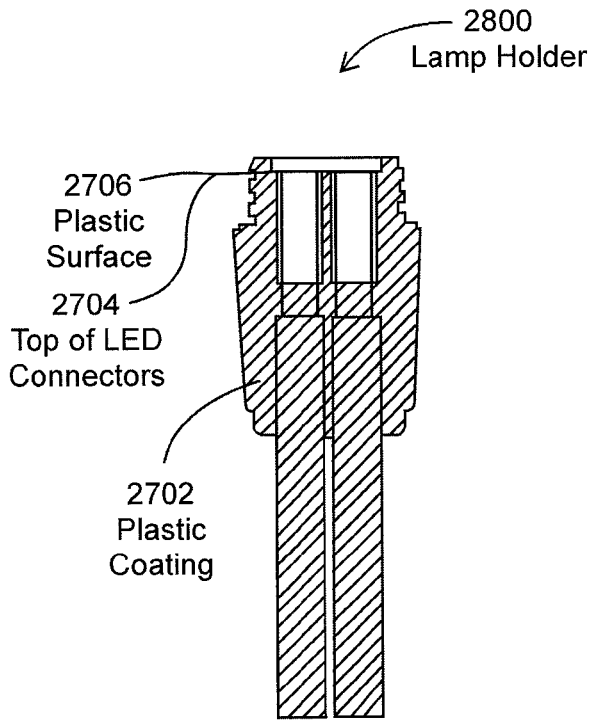
FIG. 28 is a cross sectional view of another embodiment of a lamp holder.
Figure 29:
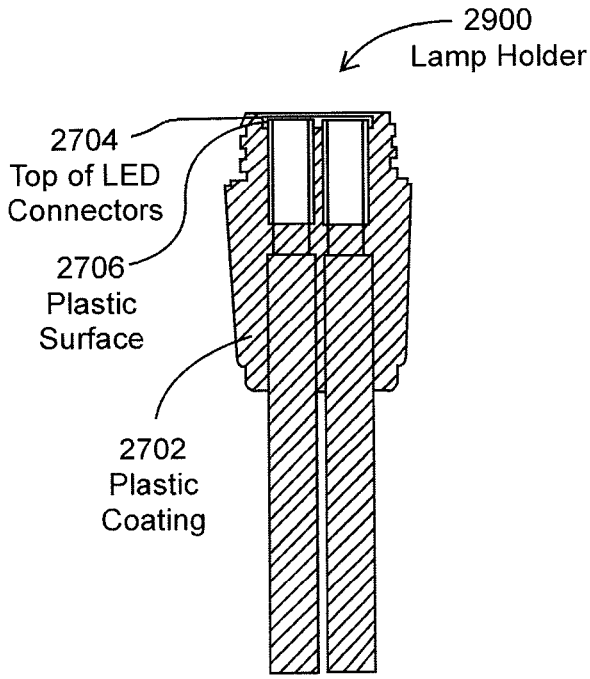
FIG. 29 is a cross sectional view of another embodiment of a lamp holder.

FIGS. 27-29 show a cross sectional view of lamp holders 2700, 2800, 2900, showing LED connectors 2604 connected to electrical wires 1402 and covered with a plastic coating 2702. The three types of lamp holders in FIGS. 27-29 are dependent upon the height of the LED connectors 2602, 2604. FIG. 27 shows lamp holder 2700 with the top of the LED terminals below plastic surface 2706. FIG. 28 shows lamp holder 2800 with the top of the LED terminals 2704 and the plastic surface 2706 at the same level. FIG. 29 shows lamp holder 2900 so that the top of LED connectors 2704 are above plastic surface 2706.

In the three different types of design of lamp holders, as shown in FIGS. 27-29, plastic surface 2706 can lie above, on the same level or below the top of connector 2704. The types of design of LED connector 2604 levels can meet different safety requirements and standards in different countries and areas in the world.

Figure 30:
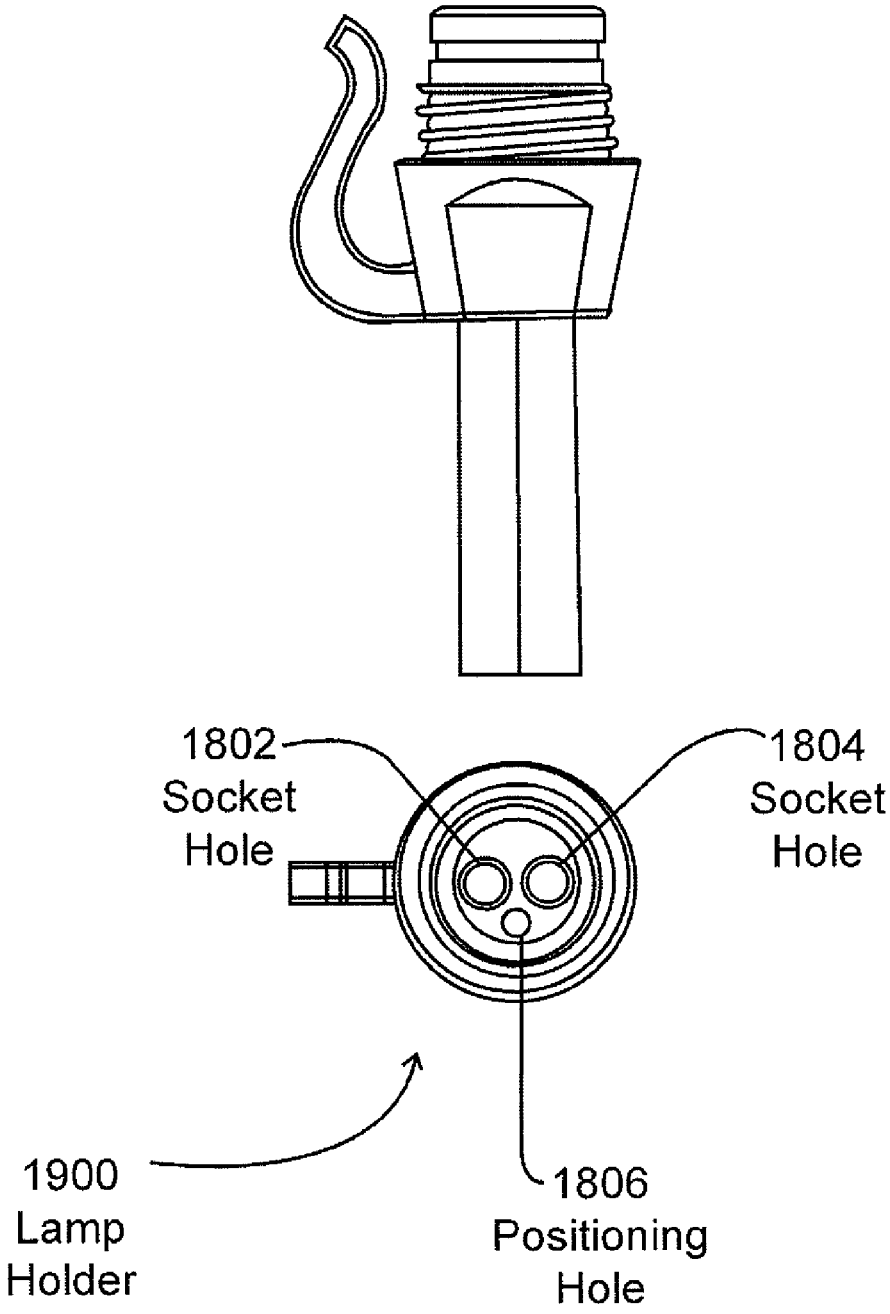
FIG. 30 is a top view of another embodiment of the lamp holder of FIG. 19.
Figure 31:
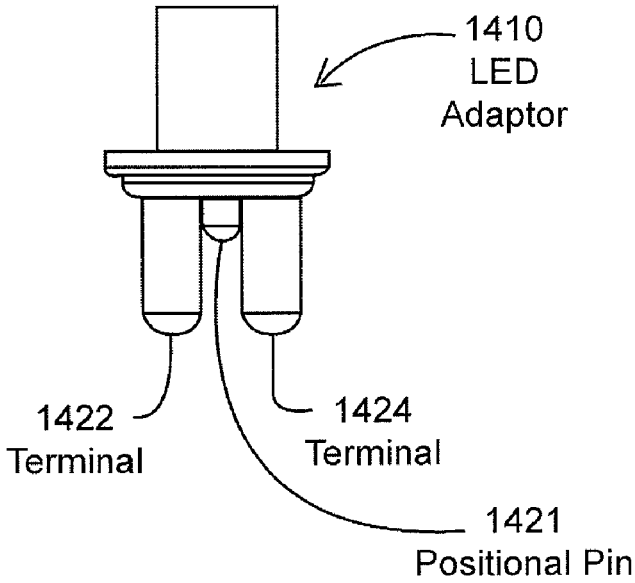
FIG. 31 is a side view of the LED adapter of FIG. 14.
Figure 32:
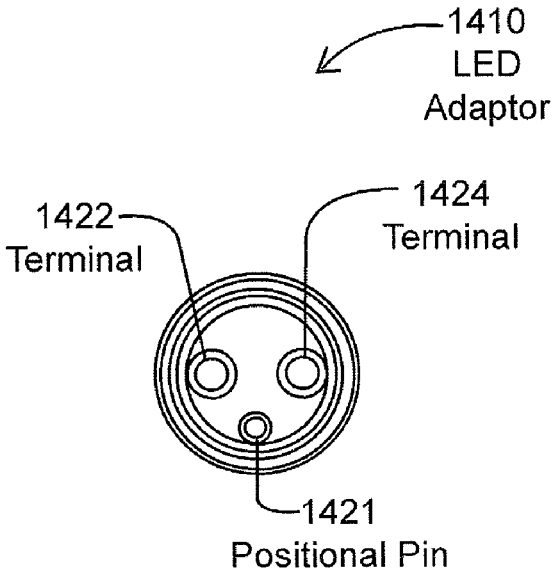
FIG. 32 is a bottom view of the LED adapter of FIG. 14.
Figure 33:
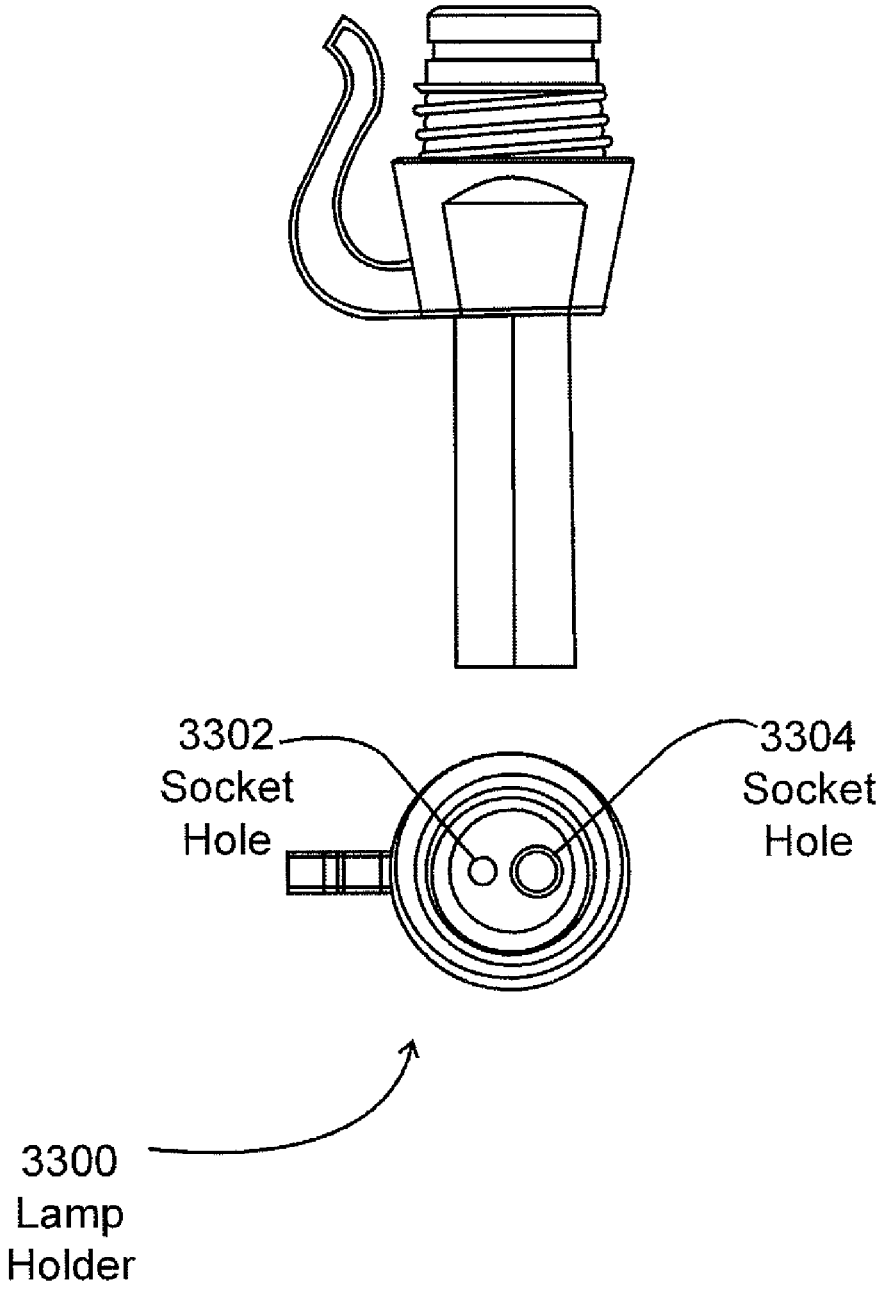
FIG. 33 is a top view of another embodiment of a lamp holder.
Figure 34:
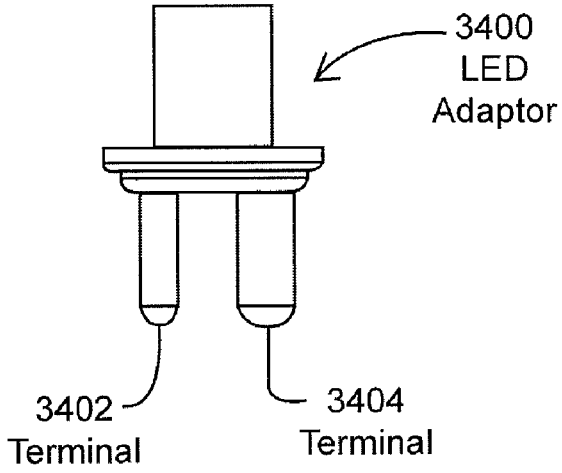
FIG. 34 is a side view of another embodiment of an LED adapter.
Figure 35:
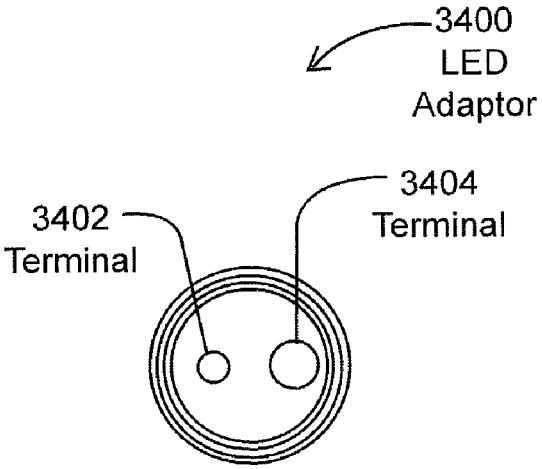
FIG. 35 is a bottom view of the LED adapter of FIG. 34.
Figure 36:
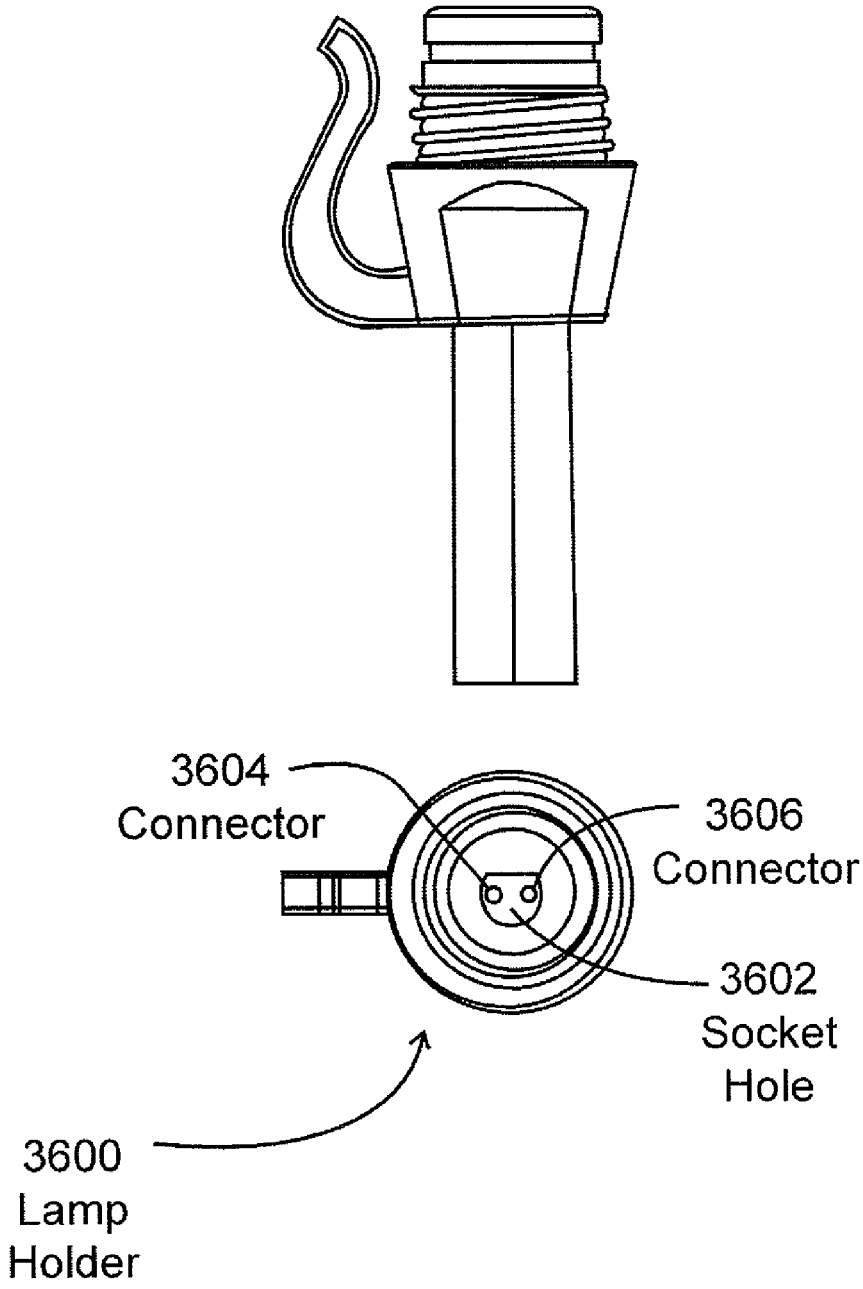
FIG. 36 is a top view of another embodiment a lamp holder.
Figure 37:
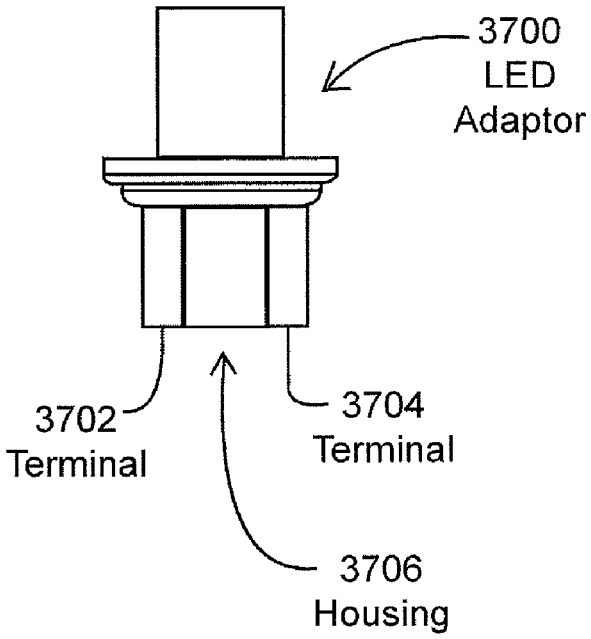
FIG. 37 is a side view of another embodiment an LED adapter.
Figure 38:
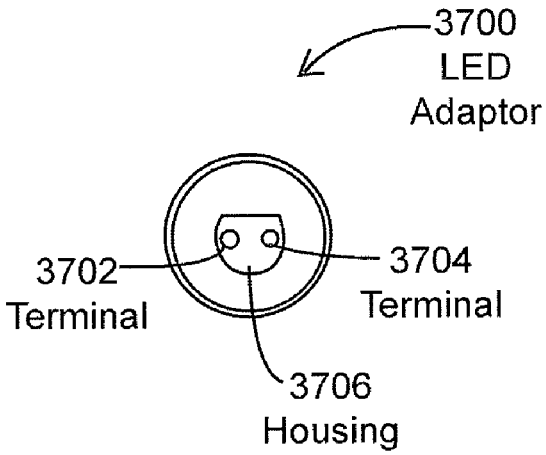
FIG. 38 is a bottom view of the LED adapter of FIG. 37.

FIGS. 30-38 illustrate three different LED adapter terminal housing and lamp holder socket hole structures to ensure the LED adaptor is disposed in the lamp holder the proper direction to account for polarity. For example, FIG. 30 shows lamp holder 1900 (previously shown in FIG. 19) having two socket holes 1802, 1804, and a positioning hole 1806. FIG. 31 is a side view of LED adapter showing terminals 2202, 2204 and positional pin 2302 that tightly engage with socket holes 1802, 1804, and positioning hole 1806 of lamp holder 1900. FIG. 32 is a bottom view of LED adapter 1410 showing terminals 1422, 1424 and positional pin 1421. FIG. 33 is a top view of lamp holder 3300 showing two socket holes 3302, 3304 so that the socket holes vary in size to distinguish polarities. As shown in FIG. 33, socket holes have different diameters. Alternatively, socket holes 3302, 3304 have different shapes or can be offset from the center of the central opening. FIG. 34 is a side view of LED adapter 3400 that fits into lamp holder 3300 showing terminals 3402, 3404 that vary in diameter to properly engage with socket holes 3302, 3304 in lamp holder 3300. FIG. 35 shows a bottom view of LED adapter 3400 showing the two LED connector terminals in different sizes to distinguish polarities when LED adaptor is inserted into lamp holder 3300. FIG. 36 shows a top view of a lamp holder 3600 with a socket hole 3602 having a directionally shaped housing for connectors 3604, 3606. FIG. 37 shows a side view of LED adapter 3700 having terminals 3702, 3704 enclosed in a housing 3706 that is directionally shaped so that terminals 3702, 3704 will comply with the polarities of connectors 3604, 3606 of lamp holder 3600 in FIG. 36. FIG. 38 is a bottom view of the directionally shaped housing of FIG. 37.

Figure 39:
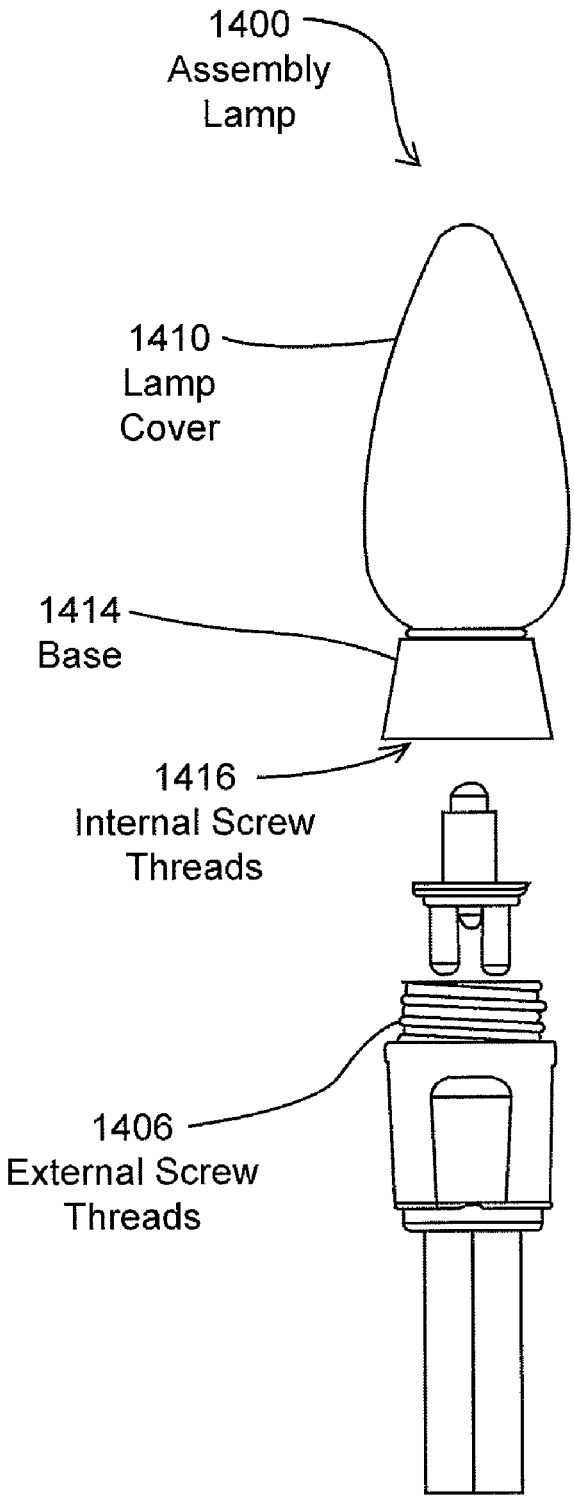
FIG. 39 is an assembly view of assembly lamp in FIG. 14.
Figure 40:
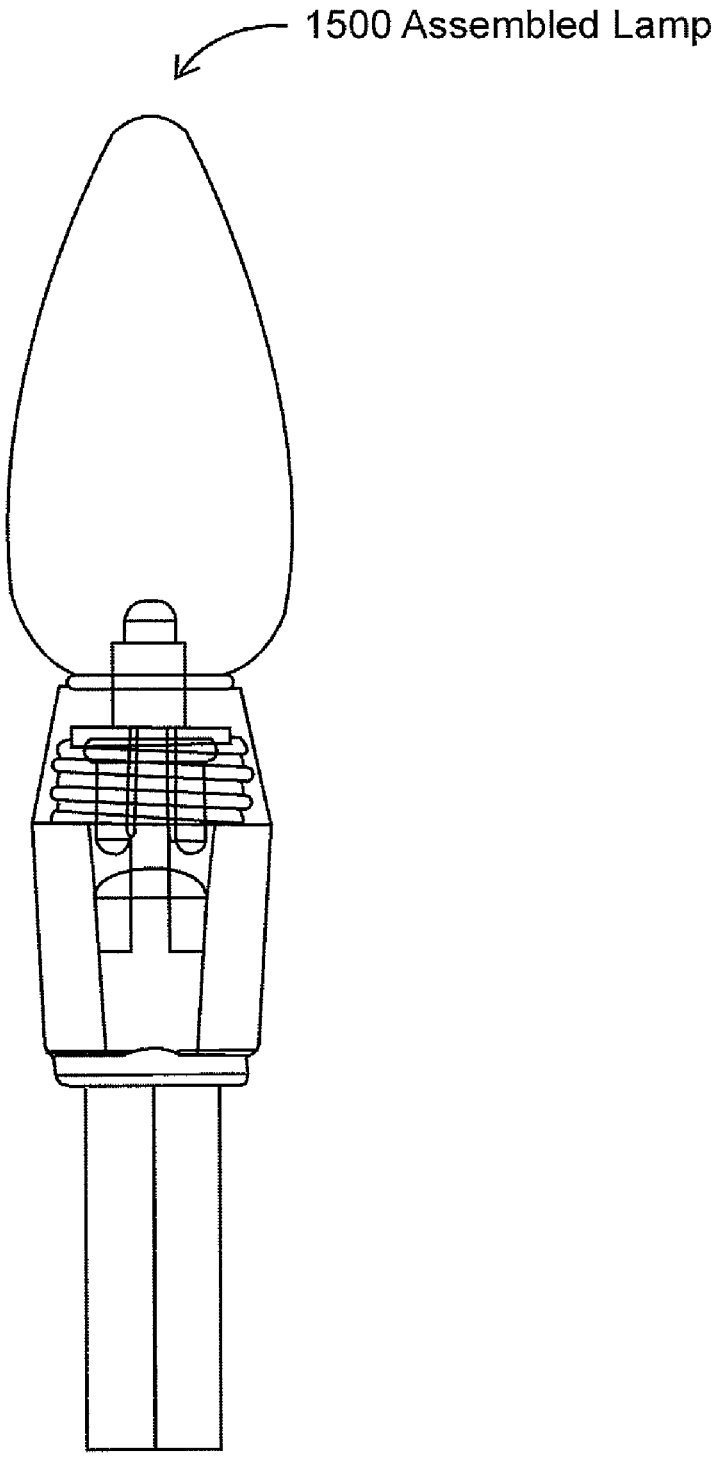
FIG. 40 is an assembled view of the lamp assembly in FIG. 15.
Figure 41:
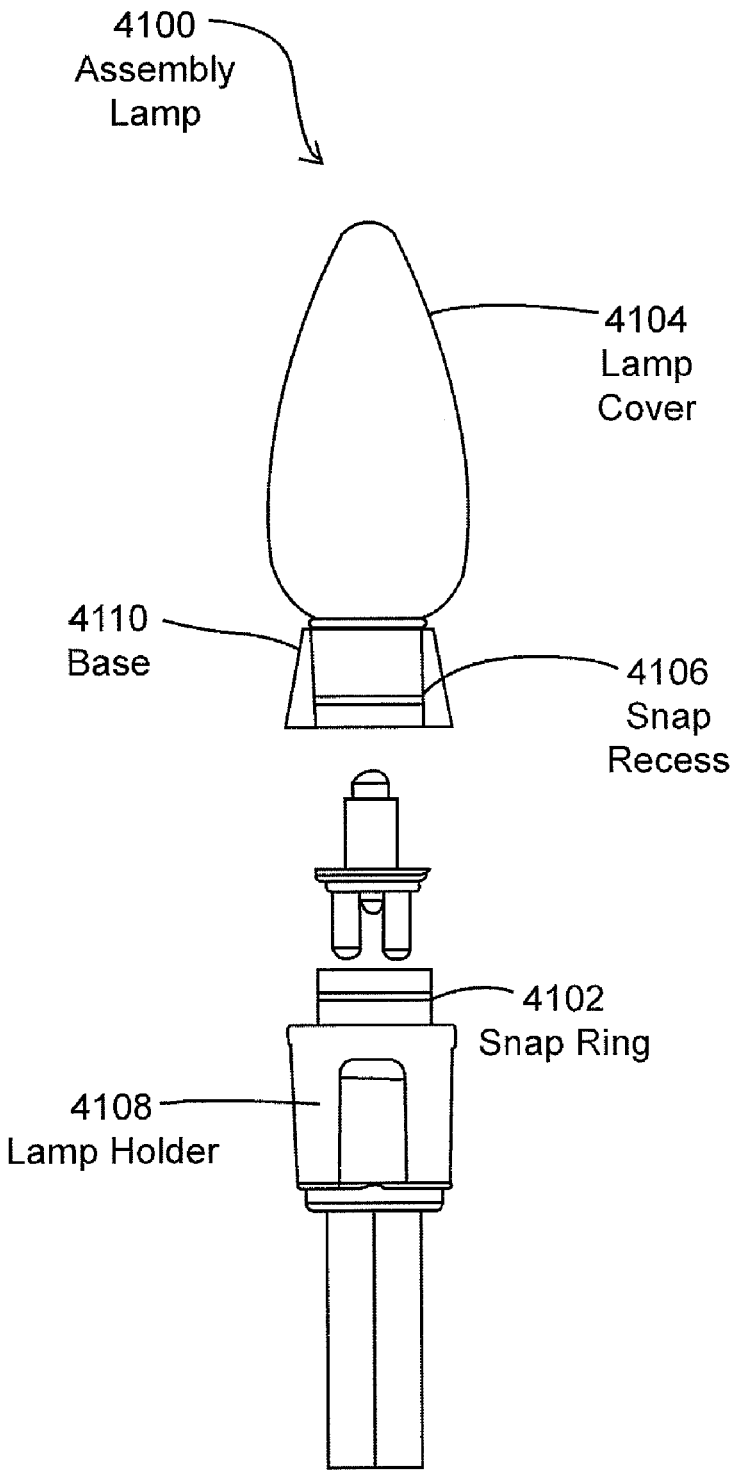
FIG. 41 is an assembly view of a lamp assembly.
Figure 42:
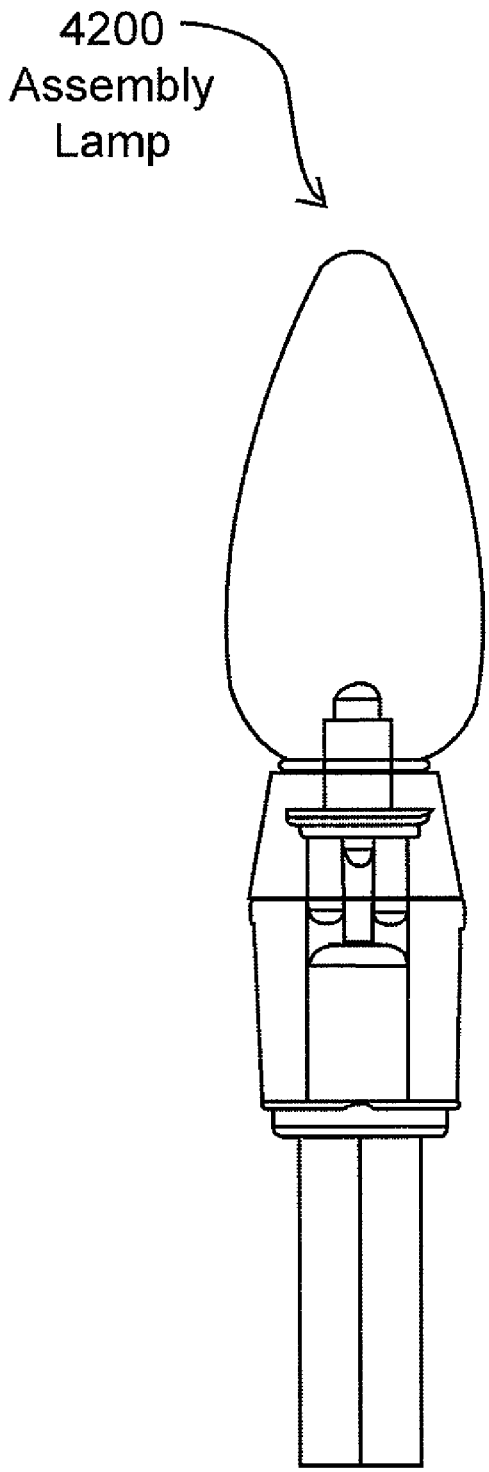
FIG. 42 is an assembled view of the lamp assembly of FIG. 41.
Figure 43:
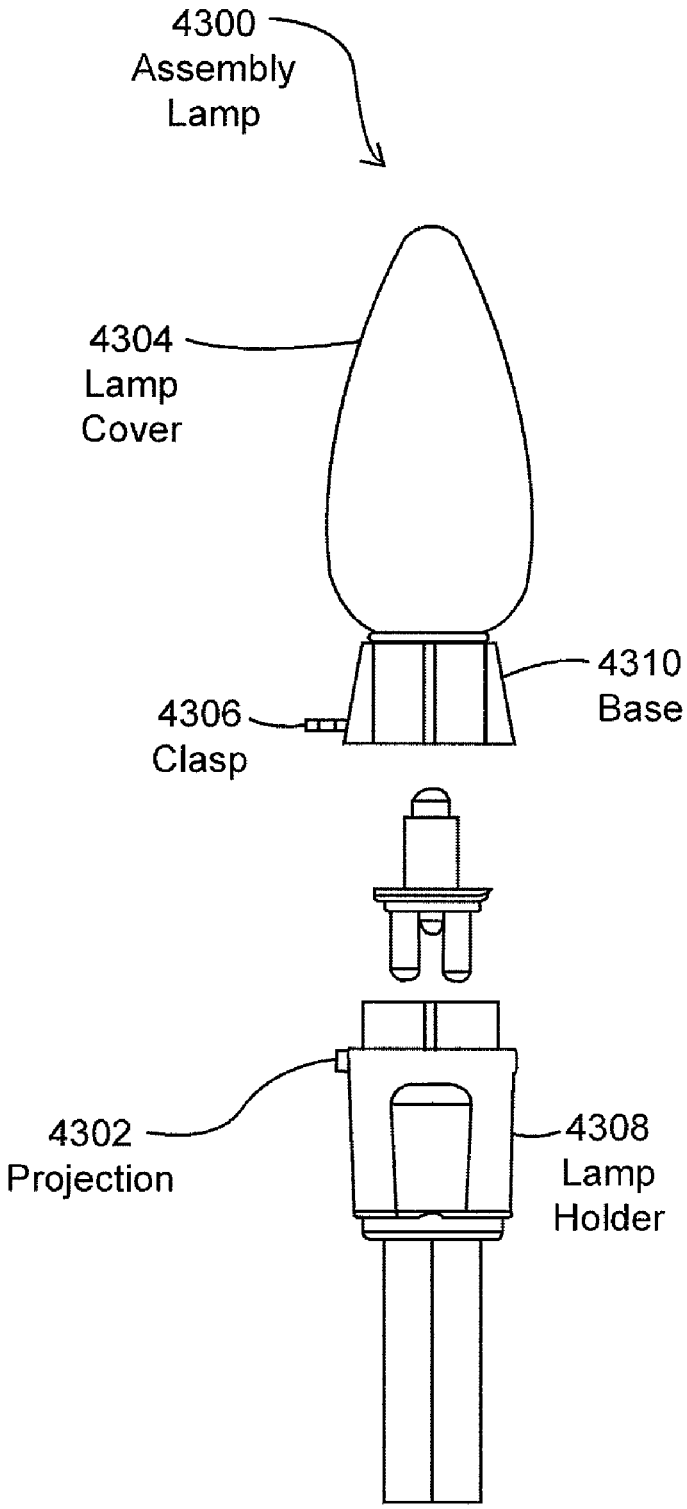
FIG. 43 is an assembly view of a lamp assembly.
Figure 44:
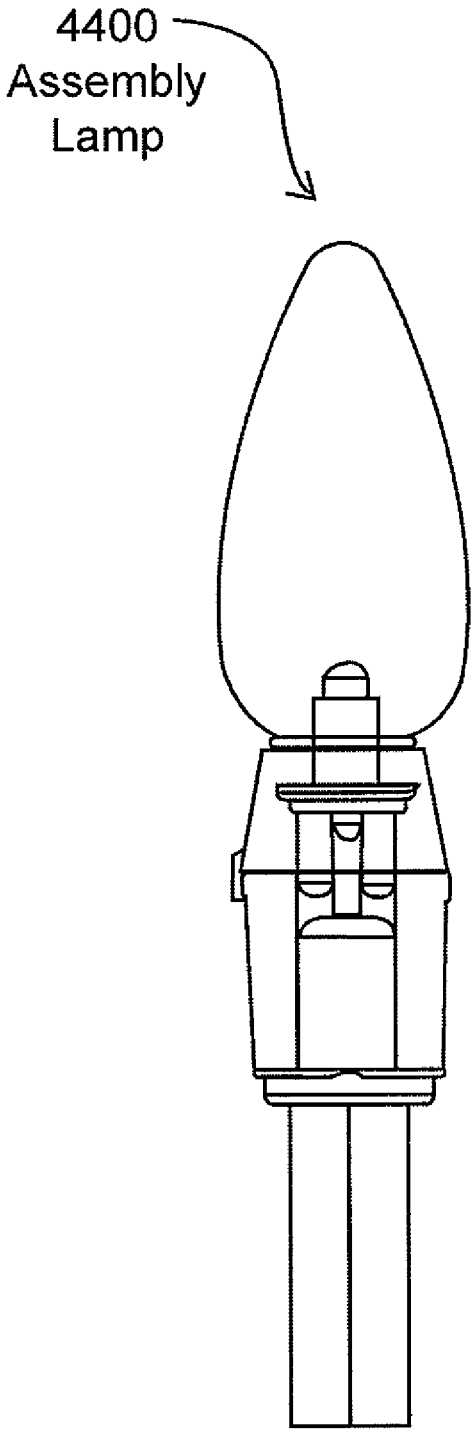
FIG. 44 is an assembled view of the lamp assembly of FIG. 43.

To achieve high water resistance, FIGS. 39-44 show three different lamp cover assembly methods. FIG. 39 shows assembly lamp 1400, as previously shown in FIG. 14, in which lamp cover 1410 is coupled with external screw threads 1406 to ensure a watertight seal for assembly lamp 1400. FIG. 40 shows assembled lamp 1500, as previously shown in FIG. 15. FIG. 41 shows assembly lamp 4100 in which lamp cover 4104 is tightly pushed onto lamp holder 1408 so snap ring 4102 receives snap recess 4106 to ensure a watertight seal for assembly lamp 4100. FIG. 42 shows assembled lamp 4200 that was shown in FIG. 41. FIG. 43 shows assembly lamp 4300, which is an additional method of attaching lamp cover 4304 to lamp holder 4308 to ensure a watertight seal. Clasp 4306 is attached to projection 4302. FIG. 44 shows the assembled lamp 4400 of the assembly lamp of FIG. 43.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A method of providing a lamp assembly for a watertight LED string that allows replacement of an LED element comprising:

providing an LED bulb having two connector pins;

providing two electrical wires;

providing two LED connectors that have different sizes;

connecting said two LED connectors to said two electrical wires;

forming a lamp holder by covering said two electrical wires and said two LED connectors with plastic to form two socket holes in said lamp holder that have different sizes, said two socket holes disposed adjacent to a central opening formed in said lamp holder;

providing an LED adaptor having two holes that releasably accept said two connector pins so that said LED bulb can be replaced in said LED adaptor;

providing two terminals disposed on a bottom portion of said LED adaptor that tightly engage said two LED connectors through said socket holes, said two terminals having different sizes that match said different sizes of said socket holes such that said LED adaptor is disposed in said lamp holder in a predetermined direction;

providing a lamp cover having a base that is secured to said lamp holder that forms a water tight seal between said base of said lamp cover and said lamp holder.

2. The method of claim 1 further comprising:

providing an extended portion of said lamp holder to form a tight seal between said lamp holder and said LED adaptor.

3. A lamp assembly for a watertight LED string that allows replacement of an LED element comprising:

an LED element having two connector pins;

two electrical wires;

two LED connectors that have different sizes that are connected to said two electrical wires;

a plastic housing that covers said two electrical wires and said two LED connectors to foam a lamp holder comprising two socket holes that have different sizes that mate with said two LED connectors that have two sizes, said two socket holes disposed adjacent to a central opening formed in said lamp holder;

an LED adapter having two holes that releasably accept two connector pins so that said LED bulbs can be replaced;

two terminals disposed on a bottom portion of said LED adapter that engage said two LED connectors through said socket holes, said two terminals having different sizes that engage said two socket holes having different sizes, so that said LED adapter engages said lamp holder in a predetermined direction;

a lamp cover having a base that is secured to said lamp holder that forms a watertight seal between said base of said lamp cover and said lamp holder.

4. The lamp assembly of claim 3 wherein said lamp holder further comprises:

an extended portion that forms a seal between said lamp holder and said LED adapter.

* * * * *